US008156582B2

(12) United States Patent
Rupar et al.

(10) Patent No.: US 8,156,582 B2
(45) Date of Patent: Apr. 17, 2012

(54) PATIENT REPOSITIONING SYSTEM

(75) Inventors: Dennis Rupar, Spring Lake, MI (US); John Walwood, Grand Haven, MI (US); Graham Weeks, Holland, MI (US); Jeffrey L. Lewandowski, Delton, MI (US); Cory P. Herbst, Shelbyville, MI (US); Jeffrey M. Gorton, Portage, MI (US); Joseph E. Mroz, Hastings, MI (US); Martin Stryker, Kalamazoo, MI (US)

(73) Assignee: Stryker Corporation, Kalamazoo, MI (US)

( * ) Notice: Subject to any disclaimer, the term of this patent is extended or adjusted under 35 U.S.C. 154(b) by 2 days.

(21) Appl. No.: 12/420,226

(22) Filed: Apr. 8, 2009

(65) Prior Publication Data

US 2009/0255057 A1 Oct. 15, 2009

Related U.S. Application Data

(60) Provisional application No. 61/043,161, filed on Apr. 8, 2008.

(51) Int. Cl.

| | |
|---|---|
| ***A61G 7/10*** | (2006.01) |
| *A61G 5/00* | (2006.01) |
| *A61G 7/053* | (2006.01) |
| *A61G 1/003* | (2006.01) |
| *A47C 21/06* | (2006.01) |

(52) U.S. Cl. ..... 5/88.1; 5/81.1 R; 5/81.1 HS; 5/84.1

(58) Field of Classification Search ..... 5/881.1, 5/84.1, 81.1 C, 81.1 HS, 81.1 R See application file for complete search history.

(56) References Cited

U.S. PATENT DOCUMENTS

| | | | |
|---|---|---|---|
| 1,815,006 | A | 7/1931 | Horsting et al. |
| 2,498,853 | A | 2/1950 | Hassold et al. |
| 2,528,048 | A | 10/1950 | Gilleland |
| 2,665,432 | A | 1/1954 | Butler |
| 2,710,975 | A | 6/1955 | Stoen et al. |
| 2,733,452 | A | 2/1956 | Tanney |
| 2,761,153 | A | 9/1956 | Mew |
| 2,812,524 | A | 11/1957 | Pruitt |
| 2,826,766 | A | 3/1958 | Stoner |
| 2,827,642 | A | 3/1958 | Huff |
| 2,959,792 | A | 11/1960 | Haugard |
| 3,205,548 | A | 9/1965 | Sanders et al. |
| 3,317,928 | A | 5/1967 | Root |

(Continued)

FOREIGN PATENT DOCUMENTS

| | | |
|---|---|---|
| DE | 2257572 | 5/1974 |

(Continued)

*Primary Examiner* — Jonathan Liu

(74) *Attorney, Agent, or Firm* — Warner Norcross & Judd LLP

(57) ABSTRACT

A patient repositioning system includes a drive unit, which is adapted for mounting to a head end of a patient support, and a clamp assembly. The clamp assembly is mounted to a headboard, which releasably mounts to the drive unit. The clamp assembly is mounted in the headboard in a stowed position and is configured for deployment from the headboard for coupling to a panel on the patient support. The drive unit includes a housing and a winding assembly supported in and enclosed by the housing. The winding assembly includes at least one tether, which is adapted to couple to the clamp assembly when the headboard is mounted to the drive unit and when the clamp assembly is deployed from the headboard. The tether is further optionally adapted to decouple from the clamp assembly when the clamp assembly is moved to its stowed position in the headboard.

26 Claims, 23 Drawing Sheets

U.S. PATENT DOCUMENTS 3,329,978 A 7/1967 Porter et al.
3,597,774 A 8/1971 Warren
3,757,359 A 9/1973 Stellman
3,829,914 A 8/1974 Treat
3,875,623 A 4/1975 Johnston
3,962,736 A 6/1976 Fedele et al.
4,011,609 A 3/1977 Bethlen
4,077,073 A 3/1978 Koll et al.
4,194,253 A 3/1980 Ullven
4,195,375 A 4/1980 Paul
4,327,453 A 5/1982 Sefton
4,627,119 A 12/1986 Hachey et al.
4,644,595 A 2/1987 Daniel
4,726,082 A 2/1988 Dimatteo et al.
4,747,170 A 5/1988 Knouse
4,776,047 A 10/1988 DiMatteo
4,796,313 A 1/1989 Dimatteo et al.
4,799,273 A 1/1989 Elze
4,821,352 A 4/1989 Dimatteo et al.
4,837,872 A 6/1989 Dimatteo et al.
4,850,562 A 7/1989 Mazzanti
4,868,938 A 9/1989 Knouse
4,872,226 A 10/1989 Lonardo
4,908,889 A 3/1990 Lonardo
5,020,171 A 6/1991 Dimatteo et al.
5,022,810 A 6/1991 Sherrow et al.
5,036,557 A 8/1991 Fales
5,038,424 A 8/1991 Carter et al.
5,054,140 A 10/1991 Bingham et al.
5,072,840 A 12/1991 Asakawa et al.
5,127,113 A 7/1992 Dimatteo et al.
5,155,874 A 10/1992 Kershaw
5,163,189 A 11/1992 DeGray
5,168,587 A 12/1992 Shutes
5,271,110 A 12/1993 Newman
5,280,657 A 1/1994 Stagg
5,319,813 A 6/1994 Dimatteo et al.
5,379,468 A 1/1995 Cassidy et al.
5,489,258 A 2/1996 Wohnsen et al.
5,524,304 A 6/1996 Shutes
5,539,941 A 7/1996 Fuller
5,544,371 A 8/1996 Fuller
5,608,929 A 3/1997 Crane
5,651,149 A 7/1997 Garman
5,692,272 A 12/1997 Woods
5,697,109 A 12/1997 Hodgetts
5,737,781 A 4/1998 Votel
5,819,339 A 10/1998 Hodgetts
D402,434 S 12/1998 Votel
5,860,174 A 1/1999 Failor
5,890,238 A 4/1999 Votel
5,901,388 A 5/1999 Cowan
5,933,884 A 8/1999 Shikinami et al.
5,966,754 A 10/1999 Schuster
5,996,144 A 12/1999 Hodgetts
6,065,162 A 5/2000 Behr
6,282,734 B1 9/2001 Holberg
6,289,533 B1 9/2001 Hodgetts
6,289,539 B1 9/2001 Alpern
6,341,393 B1 1/2002 Votel
6,349,432 B1 2/2002 Scordato et al.
6,363,555 B1 4/2002 Larose
6,378,148 B1 4/2002 Votel
6,496,991 B1 12/2002 Votel
6,507,963 B2 1/2003 Hodgetts
6,591,435 B1 7/2003 Hodgetts
6,615,423 B2 9/2003 Sverdlik et al.
6,629,323 B2 10/2003 Sverdlik et al.
6,662,388 B2 12/2003 Friel et al.
6,701,546 B2 3/2004 Hodgetts
6,728,979 B1 5/2004 Robert
6,772,456 B2 8/2004 Votel
6,820,292 B2 11/2004 Heimbrock
6,823,541 B2 11/2004 Egan
6,823,542 B2 11/2004 Berge
6,834,402 B2 12/2004 Hanson et al.
6,845,529 B2 1/2005 Berge
6,857,143 B2 2/2005 McNulty
6,857,144 B1 2/2005 Huang
6,886,194 B2 5/2005 Hodgetts
6,932,209 B2 8/2005 Kasagami et al.
6,934,980 B2 8/2005 Harney
6,938,285 B2 9/2005 Fernie et al.
6,964,070 B2 11/2005 Hawk et al.
7,000,268 B2 2/2006 Johnson
7,003,819 B2 2/2006 Weigand
7,020,912 B2 4/2006 Berge
7,032,261 B2 4/2006 Heimbrock
7,040,641 B2 5/2006 Wing
7,047,578 B2 5/2006 Spanton
7,062,803 B2 6/2006 McMahan
7,111,338 B2 9/2006 Faux et al.
7,114,203 B2 10/2006 Lloyd et al.
7,200,881 B2 4/2007 Kasagami et al.
7,210,176 B2 5/2007 Weedling et al.
7,219,377 B2 5/2007 McMahan et al.
7,290,299 B2 11/2007 Votel
7,293,303 B2 11/2007 Worrell
7,305,725 B2 12/2007 Burton
7,340,784 B2 3/2008 Stryker et al.
7,424,756 B2 9/2008 Van Raemdonck
7,434,278 B2 10/2008 White et al.
7,480,949 B2 1/2009 Bloomquist
7,487,558 B2 2/2009 Risk, Jr. et al.
7,591,030 B2 9/2009 Stryker et al.
7,725,964 B2 6/2010 Minning et al.
7,739,758 B2 6/2010 Weedling et al.
2002/0029418 A1* 3/2002 Votel ..... 5/81.1 RP
2004/0154097 A1 8/2004 Blevins
2004/0163173 A1 8/2004 Downing
2004/0177441 A1 9/2004 Ronne
2004/0221388 A1 11/2004 Votel
2005/0039256 A1 2/2005 Price et al.
2005/0055769 A1 3/2005 Taylor
2005/0076437 A1 4/2005 Johnson
2005/0193488 A1 9/2005 Blevins
2005/0217023 A1 10/2005 Tally
2005/0235415 A1 10/2005 Pederson et al.
2006/0053698 A1* 3/2006 Minning et al. ..... 52/36.4
2006/0090258 A1* 5/2006 Stryker et al. ..... 5/81.1 R
2007/0220671 A1 9/2007 Vanderheiden et al.

FOREIGN PATENT DOCUMENTS

DE 2308436 8/1974
EP 0865245 6/2005
FR 1512074 12/1967
GB 7869 5/1895
GB 420697 12/1934
GB 2068850 A 8/1981
GB 2404578 9/2005

* cited by examiner

PATIENT REPOSITIONING SYSTEM

CROSS-REFERENCE TO RELATED APPLICATION

This application claims priority from U.S. patent application Ser. No. 61/043,161, filed Apr. 8, 2008, entitled PATIENT REPOSITIONING SYSTEM, which is incorporated by reference in its entirety.

TECHNICAL FIELD AND BACKGROUND OF THE INVENTION

The present invention generally relates to a patient repositioning system and, more particularly, to a patient repositioning system for a patient support, such as a hospital bed, that allows an attendant to slide a patient on a panel, such as a sheet or a pad, on the patient support toward the head end of the patient support.

SUMMARY OF THE INVENTION

The present invention provides a patient repositioning system that includes a clamp assembly that is stored at the head end of a patient support and, further, optionally stowed in a headboard of the patient support where it may be generally hidden from view when not in use but accessible by an attendant. The patient repositioning system also includes a drive assembly for pulling on the clamp assembly to thereby pull on a panel, such as sheet or pad, once the clamp assembly is coupled to the panel. The clamp assembly and drive unit may be stowed in separate housings. For example, the clamp assembly, as noted, may be housed in the headboard, and the drive assembly may be supported in a drive unit that mounts to the patient support beneath the headboard, with the drive unit providing a mounting base for the headboard. The headboard may be releasably mounted to the drive unit such that it may be quickly removed, for example to administer treatment, such as CPR, to the patient lying on the patient support. To that end, the drive assembly may remain decoupled from the clamp assembly to allow easy removal of the headboard and instead only couples to the clamp assembly when use of the clamp assembly is desired. Further, the drive unit may be mounted to the patient support using a conventional headboard mounting arrangement so that the drive unit and the headboard may be substituted for a conventional headboard and mounted to a patient support without the need for modification.

In one form of the invention, a patient repositioning system includes a drive unit adapted for mounting to a head end of a patient support, which includes a housing and a winding assembly supported in and enclosed by the housing, and a headboard adapted to releasably mount to the drive unit. Mounted in the headboard is a clamp assembly, which is mounted in the headboard in a stowed position. The winding assembly includes one or more tethers for coupling to the clamp assembly, which is configured for deployment from the headboard for clamping on a panel supported on the patient support. Further, the tether or tethers are adapted to couple to the clamp assembly when the headboard is mounted to the drive unit and when the clamp assembly is deployed from the headboard and further are adapted to decouple from the clamp assembly when the clamp assembly is moved to its stowed position in the headboard to thereby allow the headboard to be quickly removed from the patient support.

In one aspect, the tether or tethers are adapted to couple to the clamp assembly when the clamp assembly is being deployed from the headboard. For example, the tether may comprise a strap, a cord, such as cable or rope, a tape or a chain.

In other aspects, the tether includes a tab. Further, the clamp assembly includes a latching mechanism, which aligns with the tab when the headboard is mounted to the drive unit for latching onto the tab and thereby couple to the clamp assembly. For example, the latching mechanism latches onto the tab when the clamp assembly is being deployed from the headboard so that until such time that the clamp assembly is needed the drive assembly remains decoupled from the clamp assembly.

In a further aspect, the headboard is adapted to suppress actuation of the latching mechanism when the clamp assembly is in its stowed position in the headboard and adapted to no longer suppress actuation of the latching mechanism when the clamp assembly is being deployed from the headboard.

According to yet further aspects, the clamp assembly is located in a recessed portion of the headboard when in its stowed position in the headboard. The recessed portion of the headboard includes a projection aligned with the latching mechanism when the clamp assembly is in its stowed position, which suppresses the latching function of the latching mechanism when the clamp assembly is in its stowed position to thereby inhibit actuation of the latching mechanism. When the clamp assembly is deployed, the projection no longer suppresses the latching function of the latching mechanism wherein the latching mechanism latch onto the tab and thereby couple the tether to the clamp assembly when the clamp assembly is being deployed from the headboard.

In other aspects, the clamp assembly includes one or more clamping devices. Further, the clamping devices are supported by and mounted to a transverse member, which maintains the clamps in a fixed spaced relationship, but may allow them to rotate about an axis orthogonal to the plane of the transverse member, with the tether selectively coupling to the transverse member.

According to another form of the invention, a patient repositioning system includes a headboard adapted for releasably mounting to a head end of a patient support. The headboard includes a recess or recessed portion and a clamp assembly stowed in the headboard in the recessed portion. The clamp assembly is configured for deployment from the headboard for coupling to a panel on the patient support. Further, the clamp assembly forms a releasable pivot connection at the recessed portion wherein the clamp assembly may be pivoted about the pivot connection between its stowed position in the headboard and a deployed position and further released from the pivot connection wherein the clamp assembly may be moved away from the headboard for coupling to a panel on the patient support spaced from the headboard.

In one aspect, the pivot connection includes a pivot member with a guide surface for guiding the clamp assembly onto the pivot member to thereby form the releasable pivot connection.

In further aspects, the clamp assembly forms one or more releasable pivot connections at the recessed portion wherein the clamp assembly may be pivoted about the pivot connection or pivot connections between a stowed position in the headboard to a deployed position. For example, the pivot connection may include a pivot member with a guide surface for guiding the clamp assembly onto the pivot member to thereby form the releasable pivot connection.

In yet further aspects, the clamp assembly includes a pair of clamping devices and a transverse member supporting the clamping devices. The releasable pivot connection may be formed with the transverse member.

According to other aspects, the system further includes a drive unit adapted for mounting to the head end of the patient support. The headboard is releasably mounted to the drive unit, which includes a winding assembly for coupling to the clamp assembly and for pulling on the clamp assembly.

In a further aspect, the winding assembly includes one or more tethers, with each of the tethers being guided from the driver unit by a pivotal guide, and with the guides forming releasable pivot connections with the clamp assembly.

According to yet a further aspect, the pivotal guides each include a guide surface for guiding the clamp assembly onto the pivotal guides. In addition, the drive unit includes a housing with a housing wall. The housing wall includes a pair of openings, with each of the pivotal guides pivotally mounted at a respective opening in the upper wall.

In yet another form of the invention, a patient repositioning system includes a headboard adapted for releasably mounting to a head end of a patient support. The headboard includes a recessed portion and a clamp assembly stowed in the headboard in the recess portion. The clamp assembly is configured for deployment from the headboard for coupling to a panel on the patient support. The clamp assembly includes a clamping device that includes a clamp base and a clamp arm, which is pivotal about the clamp base and movable from an open position to a closed position. The headboard is adapted to move the clamp arm to its closed position when the clamp assembly is moved to the stowed position.

In one aspect, the headboard includes a recess, with the clamp assembly located in the recess when the clamp assembly is moved to its stowed position.

In a further aspect, the recess includes a projection for closing the clamp arm when the clamp assembly is moved to its stowed position.

In other aspects, the clamp assembly includes a pair of clamping devices and a transverse member supporting the clamping devices, with the recess including a pair of projections for closing the clamp arms of both clamping devices.

According to yet another form of the invention, a patient support gripping assembly includes a shaft supported for rotation about a longitudinal axis and a reel supported on the shaft and coupled with the shaft for rotation with the shaft. The reel includes a winding surface and a transverse passage extending through the winding surface. A tether with a generally flat end is threaded through the transverse passage. After the flat end is threaded through the transverse passage, the thickness of the flat end is increased to thereby trap the tether in the transverse passage. Further, to remove the tether the thickness of the generally flat end can be reduced to thereby release the tether from the reel.

In one aspect, the distal end of the tether forms the flat end and includes a loop and a pin removably located in the loop wherein the thickness of distal end is increased when the pin is located in the loop and no longer increased when the pin is removed.

In other aspects, the reel includes two transverse passageways extending through the winding surface, and the distal end of the tether is threaded through both of the transverse passageways.

Accordingly, the present invention provides a patient repositioning device that may be stowed in a headboard without significantly impacting the ability of the headboard to be removed from the patient support. Further, the patient repositioning device may be stowed in the headboard with relative ease where the device is generally hidden from view. In addition, the winding device may be decoupled from the driver to facilitate removal of the headboard, for example, during an emergency situation.

These and other objects, advantages, purposes, and features of the invention will become more apparent from the study of the following description taken in conjunction with the drawings.

DETAILED DESCRIPTION OF THE FIGURES

DETAILED DESCRIPTION OF THE PREFERRED EMBODIMENT

Figure 1:
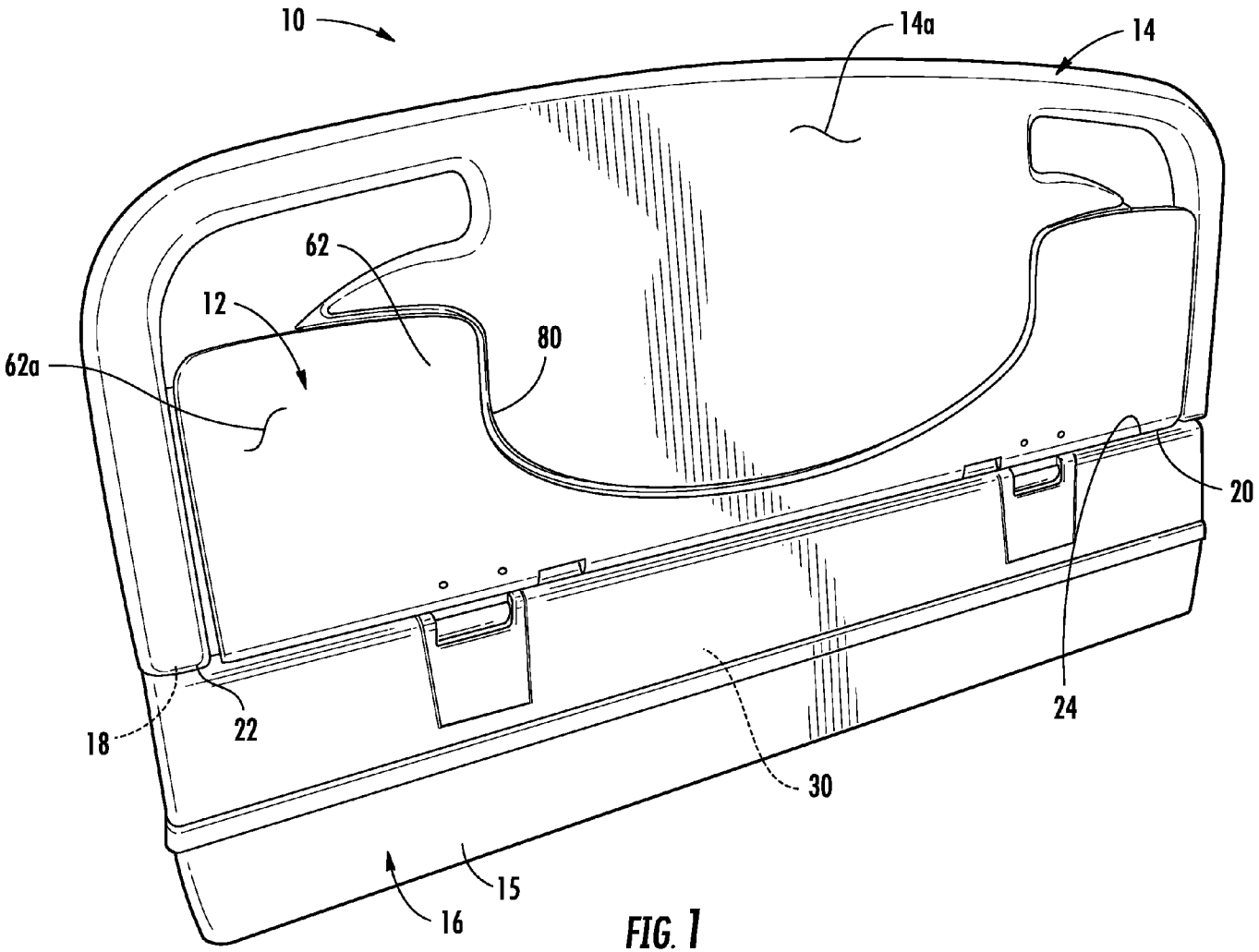
FIG. 1 is a perspective view of the patient repositioning system of the present invention.

Referring to FIG. 1, the numeral 10 generally designates a patient repositioning system of the present invention, which is configured for mounting to a patient support, such as a bed. As will be more fully described below, patient repositioning system 10 incorporates a clamp assembly 12 for clamping on a panel, such as a sheet or pad, on which a patient lies when supported on the patient support, and a drive assembly 30 for pulling and translating the clamp assembly relative to the patient support to thereby pull and move the patient on the panel, for example to the head end of the patient support for repositioning the patient on the patient support.

Figure 2:
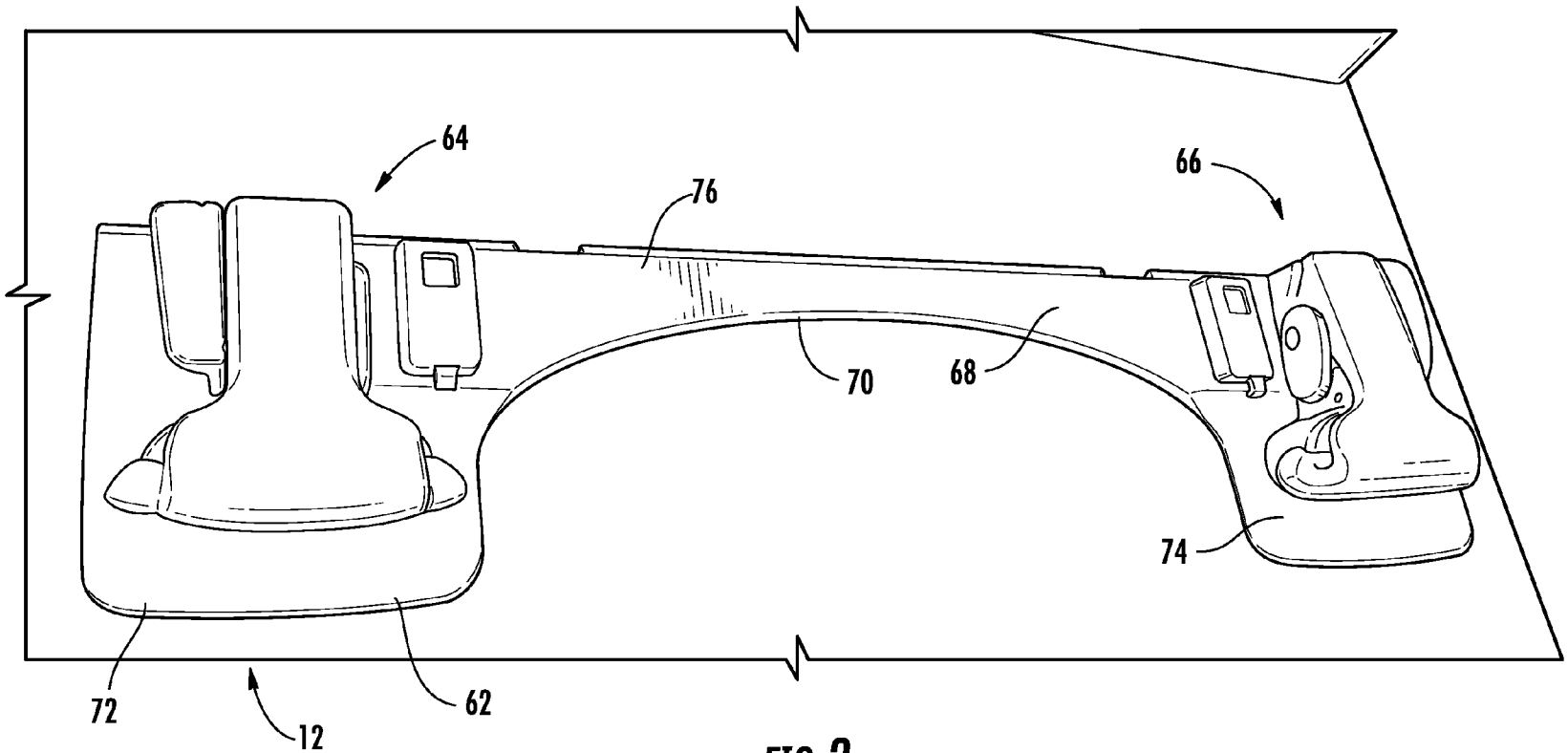
FIG. 2 is a perspective plan view of the clamp assembly of the patient repositioning system of FIG. 1.
Figure 5:
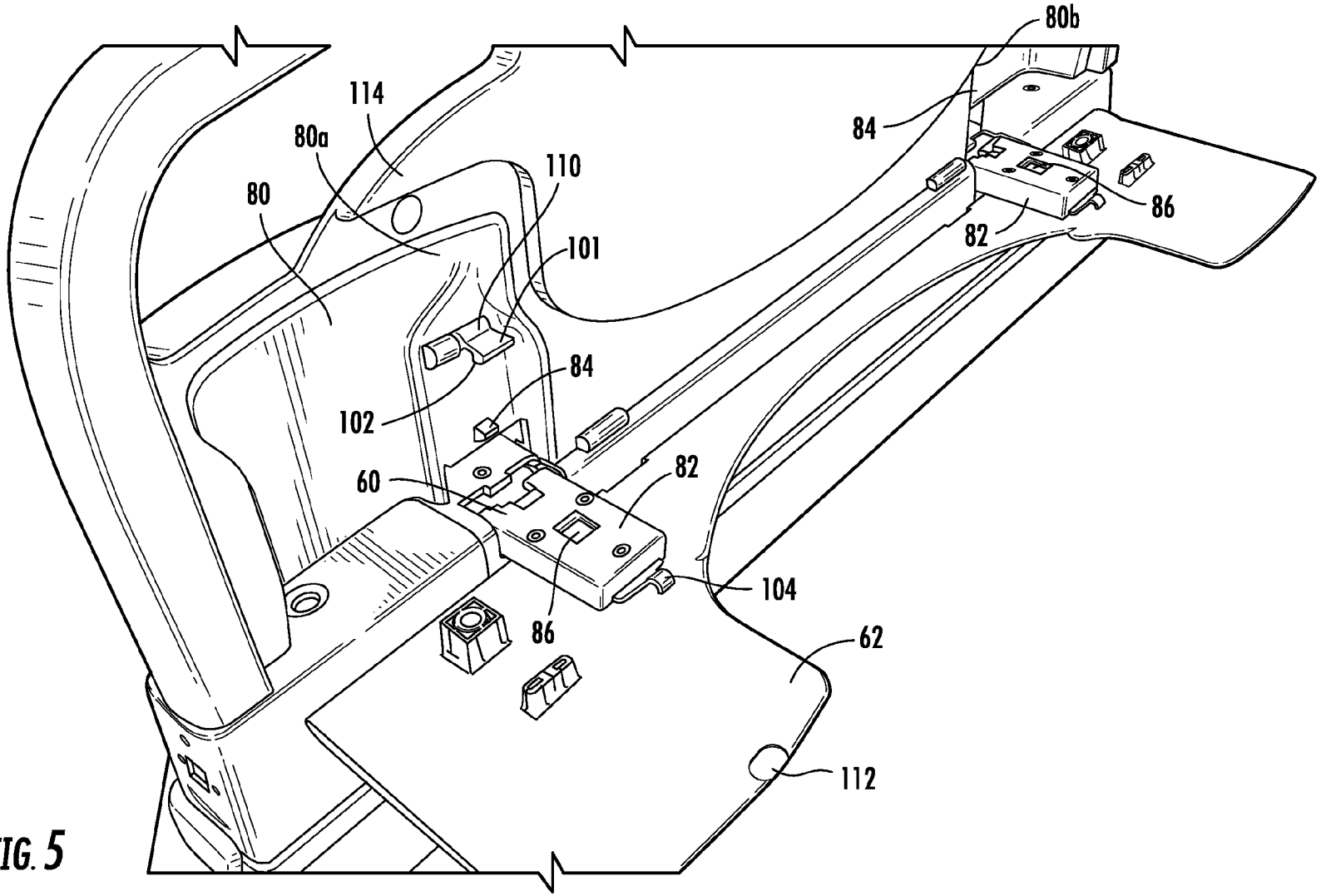
FIG. 5 is an perspective view of the patient repositioning system of FIG. 1 with the clamp assembly deployed from the headboard and with the clamping devices removed.

As best understood from FIGS. 1, 2, and 5, clamp assembly 12 (FIG. 2) is stowed and removably mounted in a headboard 14. Drive assembly 30 is enclosed in a housing 15, which together form a drive unit 16 and which is adapted to mount to a head end of the patient support. Further, drive unit 16 may form a mounting base on which headboard 14 may be removably mounted.

Headboard 14 includes a pair of downwardly extending posts 18 and 20 that extend into a corresponding pair of sockets 22 and 24, which are formed in drive unit 16 to thereby releasably mount headboard 14 to drive unit 16. Housing 15 of drive unit 16 is adapted to mount to the head end of a patient support using a similar post and socket arrangement, with the sockets formed in the drive unit for receiving the posts on a patient support, which is similar to a conventional headboard mounting arrangement in a bed. Therefore, patient repositioning system 10 may replace a conventional headboard without requiring modification; though it should be understood that other mounting arrangements may be used. Further, as will be more fully described below, with this mounting arrangement, the headboard can be removed without removing the drive assembly, which is particularly useful during an emergency, for example when administering treatment, such as CPR, to the patient lying on the patient support.

Figure 3:
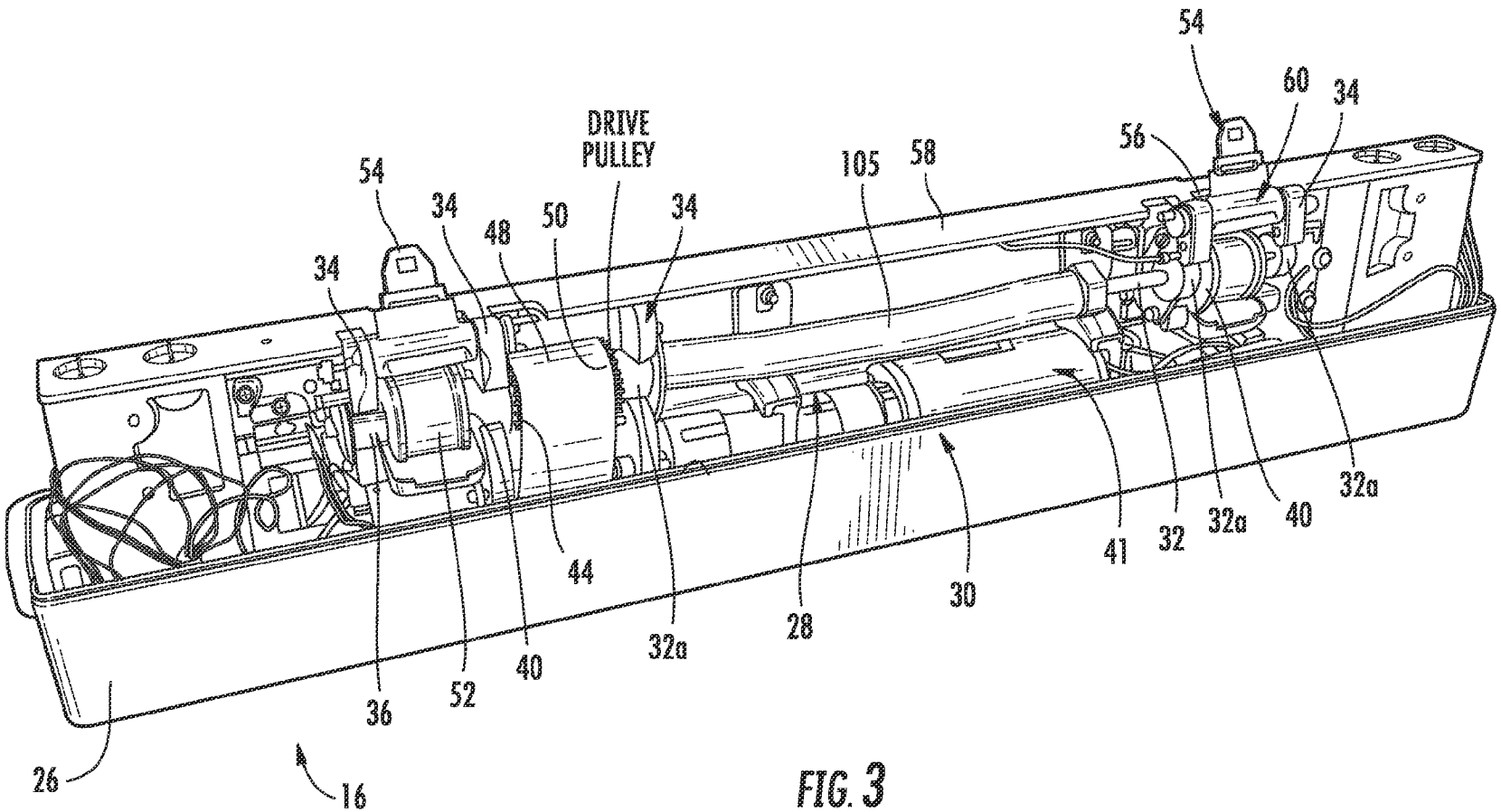
FIG. 3 is a perspective view of the drive unit of the patient repositioning system with a portion of the housing removed to show the winding assembly and the drive assembly.

As best seen in FIG. 3, drive unit 16 includes a winding assembly 28 and drive assembly 30, which are supported and enclosed in the housing. Winding assembly 28 includes a shaft 32, which is supported in housing 15 of drive unit 16 by a pair of supports 34, such as C-shaped blocks, that are secured to the housing by fasteners. For example, suitable supports may include metal, such as aluminum, or plastic supports. Supports 34 are positioned at intervals along the length of shaft 32, with the shaft including bearing blocks 36 at each of the points of support so as to allow shaft 32 to rotate about its longitudinal axis. In this manner, shaft 32 is rotatably mounted in drive unit 16. Mounted about shaft 32 are one or more reels or spools 40, which are rotatably coupled with the shaft for rotation with the shaft about the shaft's longitudinal axis and together with the shaft form the winding assembly. Optionally, reels 40 may be releasably mounted to the shaft so that the reels may be removed for replacement, as will be more fully described below.

Figure 3A:
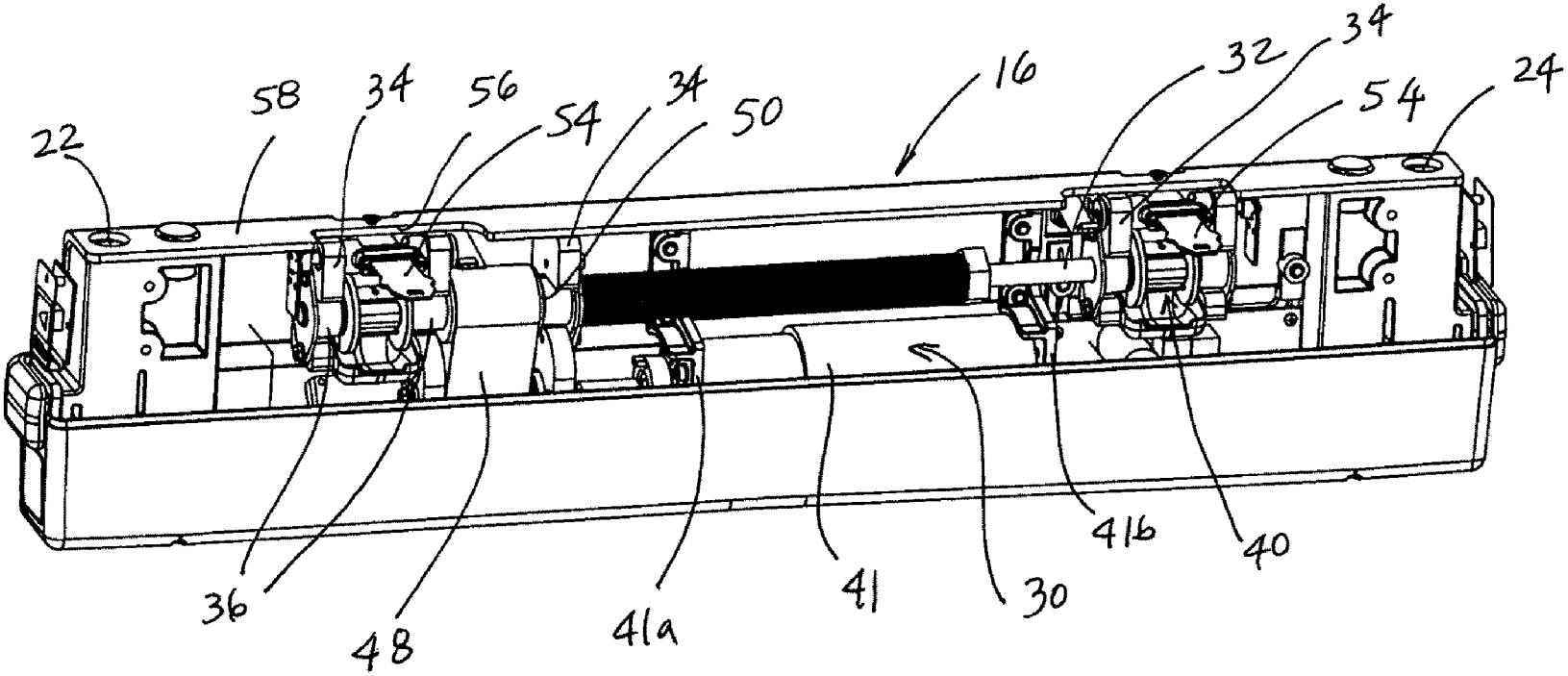
FIG. 3A is a similar view to FIG. 3 illustrating the pivotal guides rotated 90° relative to the drive unit.
Figure 3B:
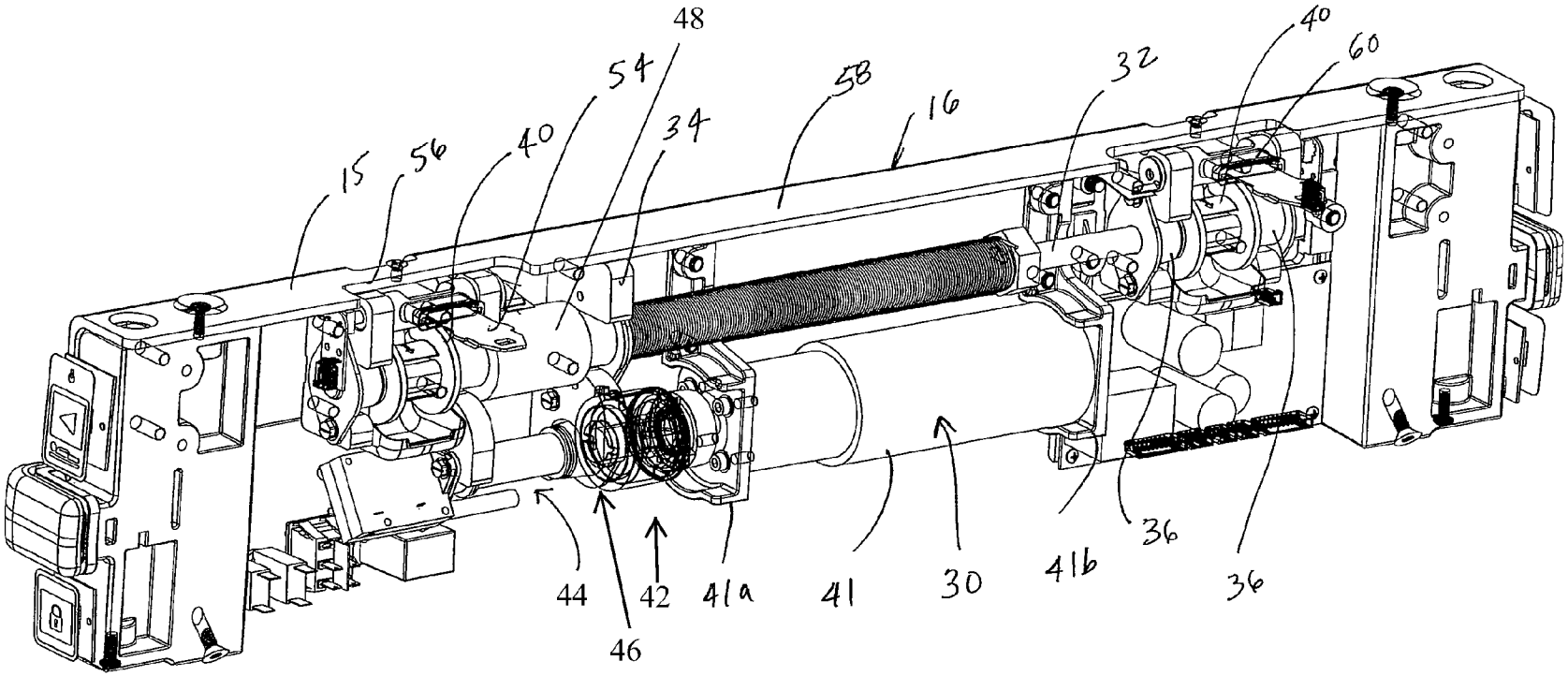
FIG. 3B is an enlarged view of the drive unit with more of the housing removed to show the mounting arrangement of the drive assembly.
Figure 3C:
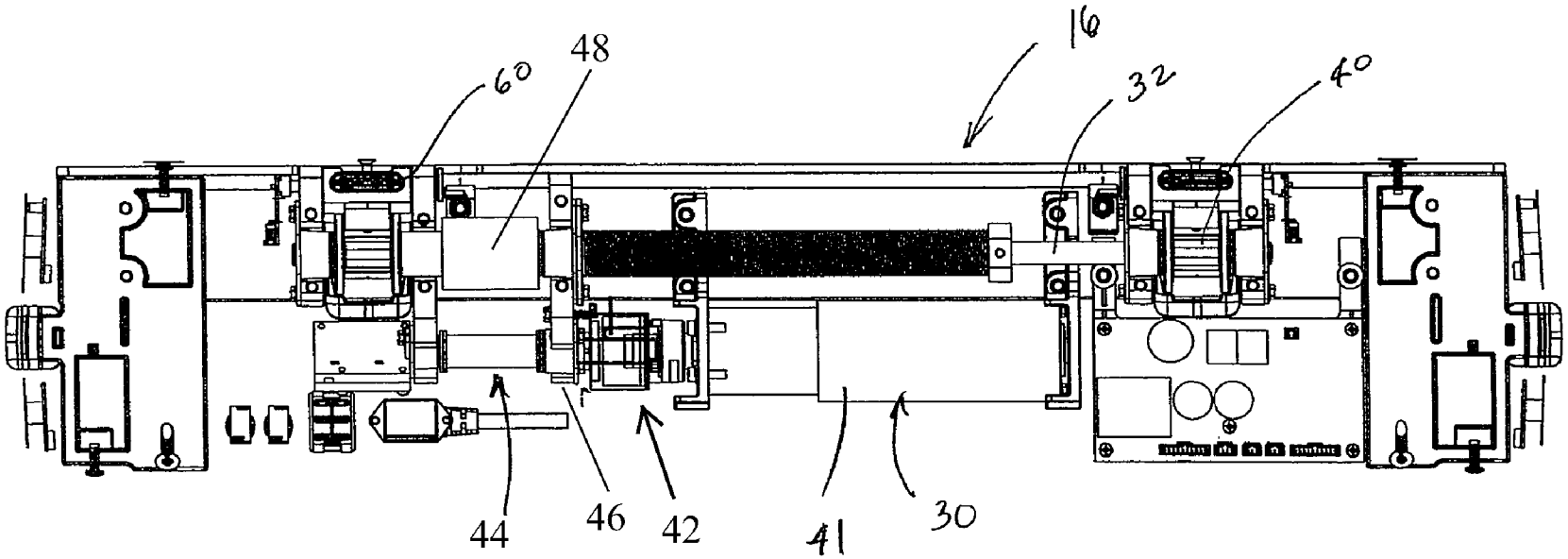
FIG. 3C is an elevation view of the drive unit with a portion of the cover removed for clarity.
Figure 3D:
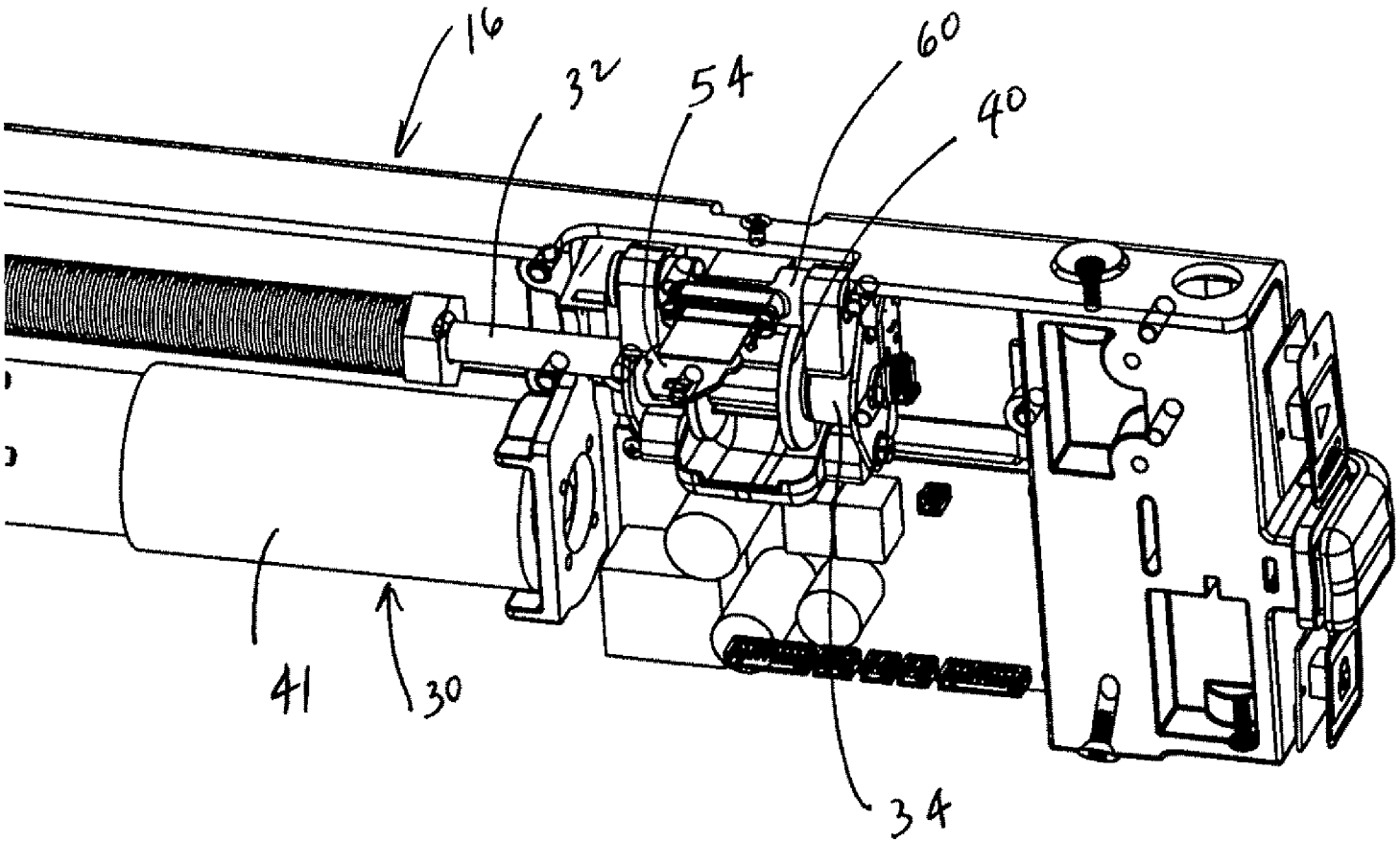
FIG. 3D is an enlarged view illustrating the mounting of the winding assembly shaft and of the various components in the drive unit.

Shaft 32 is selectively driven about its longitudinal axis by drive assembly 30. In the illustrated embodiment, drive assembly 30 includes a motor 41, a clutch assembly 42, a gear reducer 46, drive pulley 44, driven pulley 48, and a drive belt 50. The motor 41 is supported in housing by a pair of motor supports 41*a* and 41*b* (FIGS. 3A and 3B) and includes a motor shaft, which is coupled to clutch assembly 42 whose output is then coupled to drive pulley 44 through gear reducer 46. Drive pulley 44 is drivingly coupled to shaft 32 by driven pulley 48, which is mounted to shaft 32, and by drive belt 50 so that when the motor 41 is energized, shaft 32 will be driven about its longitudinal axis.

Figure 4:
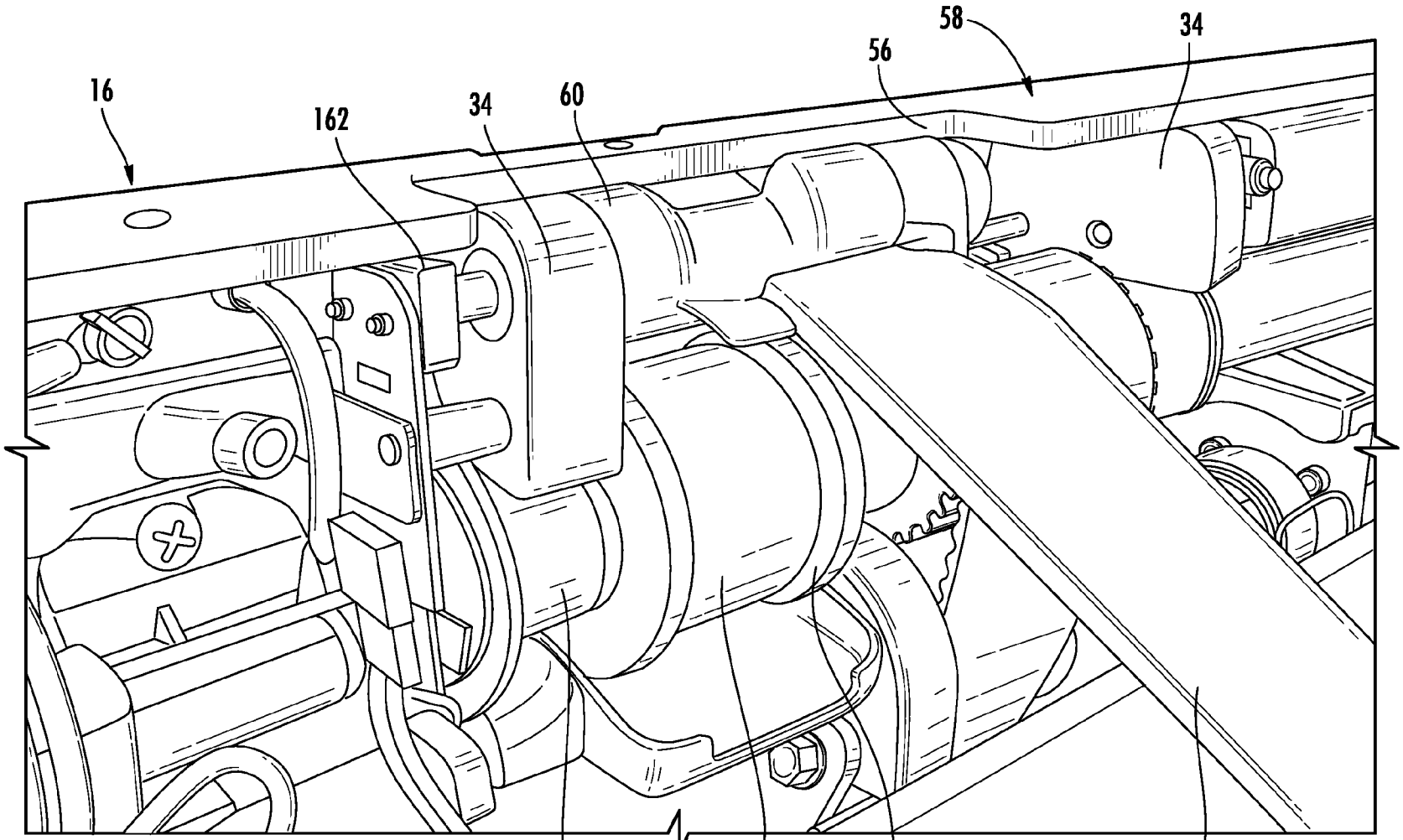
FIG. 4 is an enlarged perspective view illustrating the pivotal guide.

Referring to FIGS. 3 and 4, secured to each reel 40 is a tether 52. In the illustrated embodiment, each tether 52 comprises a strap; however, it should be understood that other suitable tethers may be used for example, a cord, such as a roe or cables, a tape, or a chain. When shaft 32 is driven by motor 41, tethers 52 are wound about reels 40 and retracted into drive unit 16. Clutch assembly 42 allows decoupling of shaft 32 from the motor's drive shaft so that tethers 52 may be extended from the drive unit for coupling to the clamp assembly, also more fully described below. The proximal end of each tether 52 is secured to a respective reel 40, and the opposed distal end of each tether is secured to a tab 54, such as a metal tab, which is used to couple the drive assembly 30 to clamp assembly 12. As best seen in FIG. 3, when tethers 52 are fully retracted into drive unit 16, tabs 54 are positioned so they project upwardly through openings 56 formed in the upper wall 58 of drive unit housing 15 for engagement by the clamp assembly, more fully described below. Further, the distal ends of tether 52 are extended through pivotal guides 60, which are mounted to housing 15 at openings 56, and thereafter coupled to the tabs so that guides 60 act as stops for the tabs. Pivotal guides 60 not only guide the tethers from the drive unit and may act as stops for the tabs; they may also provide a pivot connection for the clamp assembly more fully described below.

Referring to FIG. 2, clamp assembly 12 includes a transverse member 62 and a pair of clamping devices 64 and 66, which are mounted, using for example fasteners, to transverse member 62 so that clamps 64 and 66 remain in a fixed spaced relationship, and optionally may be allowed to pivot about an axis to the plane of transverse member 62. By supporting clamping devices 64 and 66 in a fixed spaced relationship, the clamping devices will resist any tendency to gravitate toward each other when pulling on a panel, otherwise known as the "tacoing" effect. Further, by mounting the clamping devices on a common member, the clamping devices may be handled as a unit and, further, stowed as a unit, as noted above, which facilitates the use of the system and the robustness or capacity of the system.

In the illustrated embodiment, transverse member 62 is formed from a rigid plate 68, such as a metal plate, which includes a cut out central portion 70 to accommodate the head of a patient lying on the patient support surface, leaving two enlarged plate sections 72 and 74 interconnected by an upper plate section 76. With this shape, clamp assembly 12 may be moved in close proximity to a patient's head. It should be understood that the plate may be made from other materials, for example polymers, including fiber reinforced or glass-filled polymers.

Referring again to FIG. 1, when stowed, clamp assembly 12 is located in a recess 80 formed in headboard 14. Furthermore, as best understood from FIG. 1, recess 80 may be configured to fully receive and house the clamp assembly within headboard 14 such that the outer surface 62*a* of transverse member 62 lies generally flush with the outer surface 14*a* of headboard 14. Referring to FIG. 5, recess 80 includes two recessed portions 80*a* and 80*b*, which generally correspond in shape to plate portions 72 and 74 and, further, have a depth to receive the respective clamping devices 64 and 66 within the headboard as noted above. In this manner, when clamp assembly 12 is returned to its stowed position within the headboard, the clamping devices are essentially hidden from view and the clamp assembly appears to be an integrated part of the headboard.

Figure 6:
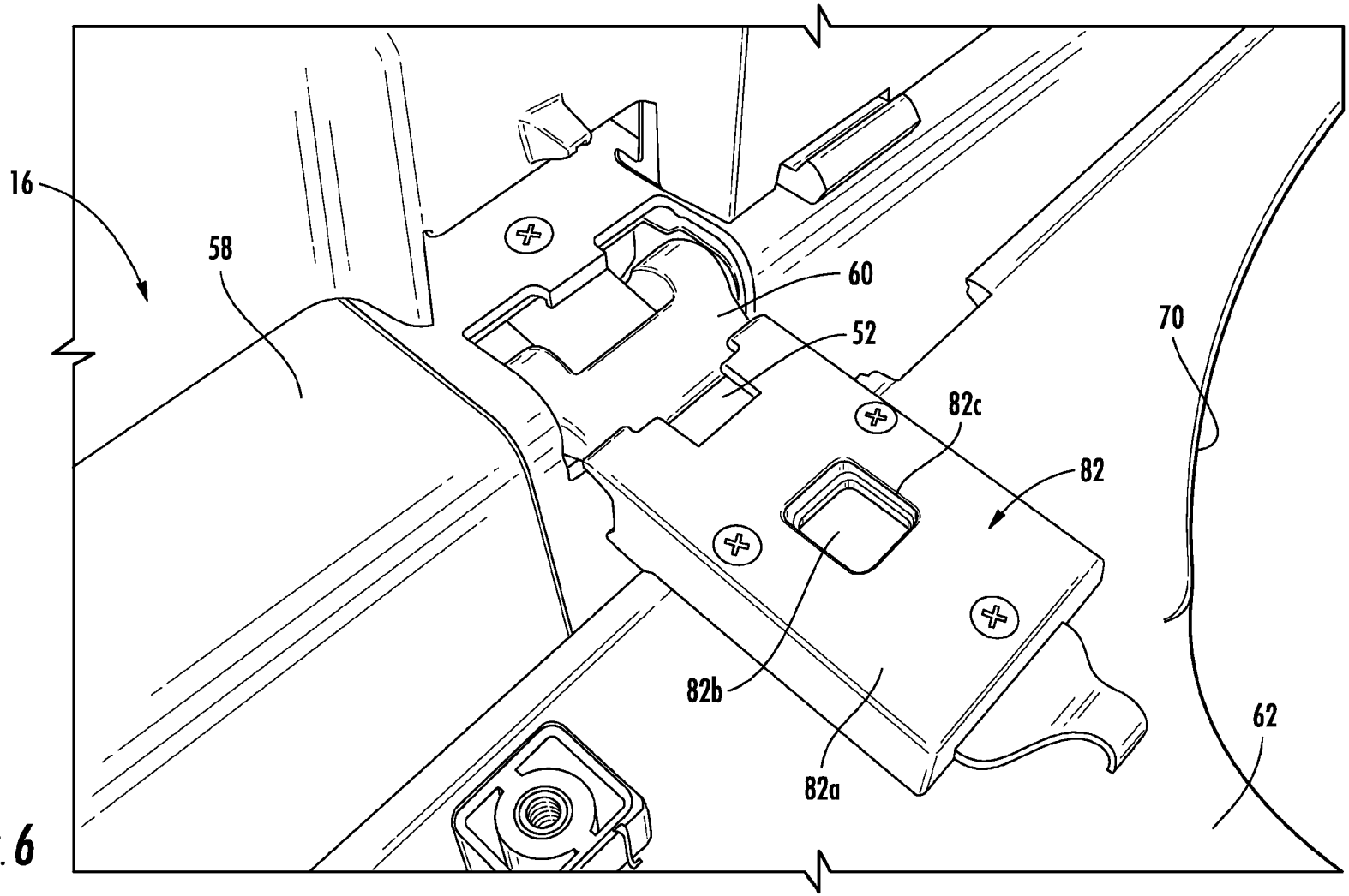
FIG. 6 is an enlarged view of the latching assembly of the clamp assembly.

To mount the clamp assembly in the headboard, clamp assembly 12 includes two latching mechanisms 82, which align with the respective tabs (54) of the tether (52) when headboard 14 is mounted to base unit 16. Referring to FIG. 6, latching mechanisms 82 each include a housing 82*a* that houses a latch plate 82*b* that is biased into an engagement position for releasably engaging a tab inserted into the housing. Housing 82*a* includes an opening 82*c*, which provides access to the latch plate, which can be pressed to move the latch plate out of its engagement position. Thus, when latching mechanisms 82 are aligned with the tabs, and the tabs inserted into housing 82*a*, the latch plate is biased to engage the tab. When initially aligned with the respective tabs, however, the latch plate of the latching mechanisms 82 are optionally deactivated from engagement with the respective tabs by a pair of protrusions or projections 84 formed in the recess portion 80 of headboard 14. Protrusions 84 extend into openings 82*c* and press or apply a compression force to the latch plate 82*b* of the respective latching mechanisms to disengage the latch plates from engagement with the tabs. However, once the clamp assembly is pivoted out of recess 80, protrusions 84 disengage from the latch plates 82*b* to allow the latch mechanisms 82 to latch onto the respective tabs of the tether.

Figure 7:
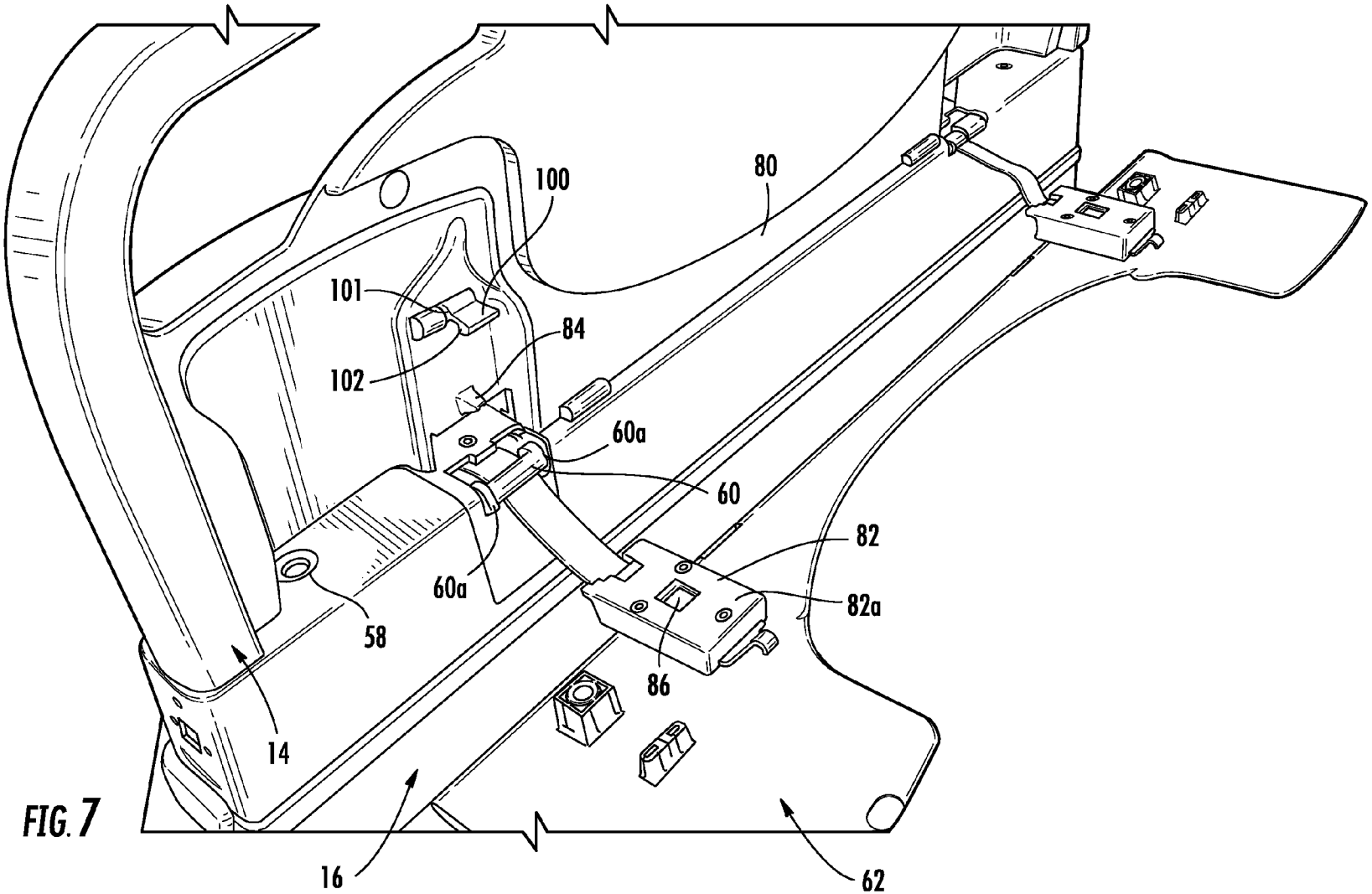
FIG. 7 is a similar view to FIG. 5 illustrating the clamp assembly deployed and, further, translated with respect to the headboard.

Further, when the tabs insert into the latching mechanisms, the housing of the latching mechanisms are guided onto and into releasable engagement with pivotal guides 60 such that the pivotal guides together with the latching mechanisms form pivot connections for the clamp assembly in the patient repositioning system. The pivot connections are releasable so that once the clamp assembly is rotated, as shown in FIG. 6, the clamp assembly may then be pulled away from the headboard along with the respective tethers leaving the pivotal guides 60 in a pivoted position such as shown in FIG. 7. As the clamp assembly 12 is pulled from the headboard, the tethers will rotate the shaft 31, which is declutched from the motor 41 by clutch assembly 42. In this manner, the attendant may move the clamp assembly toward the patient so that the clamp devices may be clamped onto the respective panel on which the patient is lying. Once the clamp devices are clamped onto the panel, the attendant may then actuate the drive system to pull the clamp assembly toward the headboard and, thereby, move the patient to the head end of the bed. Once the patient is properly positioned, the clamp devices may then be decoupled or unclamped from the panel so that the clamp assembly may be returned to the headboard.

Referring again to FIGS. 6 and 7, when returning the clamp assembly to the headboard, latch assembly housings 82*a* should be aligned with pivotal guides 60, which include guide surfaces 60*a* on their opposed sides, which are angled inwardly toward the tethers so that the guide surfaces 60*a* will guide the latch mechanism housings 82*a* onto the pivotal guides. Once seated on the pivotal guides 60, clamp assembly 12 may then be pivoted about the pivot connection formed between the latch mechanisms and the pivot guides. Alternately or in addition, transverse member 62 may pivot about an edge provided at the covers, for example by a landing provided at the cutout or opening in the cover through which the tethers extend.

In addition to the protrusions that may be used to deactivate the latch plate of the latch mechanisms, recess 80 may include protrusions or ramped surfaces that cooperate with the lever arms of the clamping devices to urge the lever arms to their locked positions so that in the event that the clamp assembly is moved back into the headboard before the clamping devices have been completely or even partially closed the force of the clamp assembly when being pivoted into the recess may be used to close the clamping devices.

Figure 8:
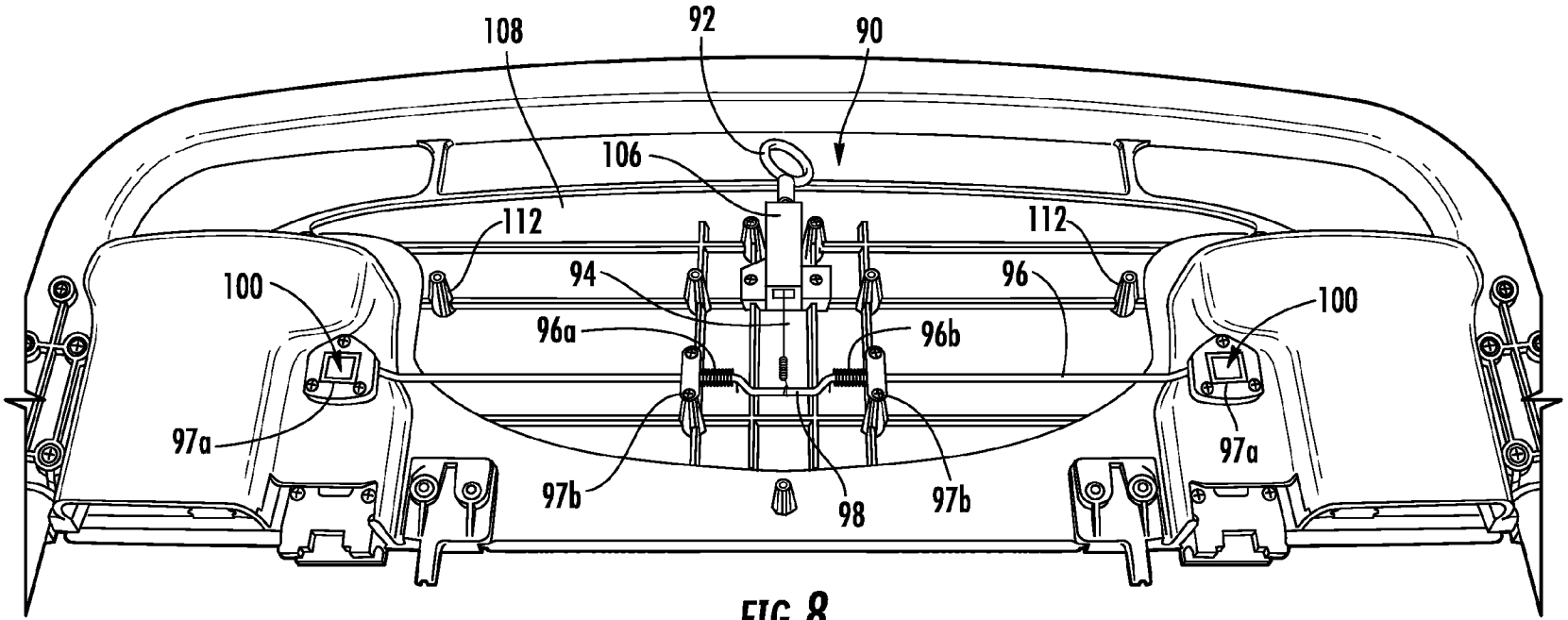
FIG. 8 is a rear perspective view of the headboard assembly with the rear cover removed to show the quick release mechanism.

To secure the clamp assembly in recess 80, headboard 14 includes release mechanism 90, which is best seen in FIG. 8. Release mechanism 90 includes a handle 92, a cable 94, and a transverse rod 96. Cable 94 couples handle 92 to transverse rod 96, which is supported for rotational movement about its longitudinal axis by a plurality of supports 97*a* and 97*b* and further biased by a pair of springs 96*a* and 96*b*. Transverse rod 96 includes a central offset portion 98 between supports 97*b* and between springs 96*a* and 96*b*, with cable 94 coupled to central offset portion 98 in a manner so that when handle 92 is pulled upward as viewed in FIG. 8, rod 96 will rotate against the bias force of the springs. Mounted to the opposed ends of rod 96 are a pair of latch mechanisms 100 (see also FIG. 5), which comprise pivotal arms 101 with a ramped engagement surfaces 102 for engaging a corresponding structure 104 (FIG. 5), such as a hook, provided on transverse member 62. Springs 96*a* and 96*b* are mounted about rod 96 to bias rod 96 so that latch mechanisms 100 are in an extended position from the bed facing side of headboard 14. Thus, when the clamp assembly is moved to its stowed position within recess 80, ramp surfaces 102 will guide the arms 101 over hooks 104 to allow the arms 101 then to latch onto the hooks to retain the clamp assembly in recess 80. However, once handle 92 is pulled vertically, cable 94 will pull on offset portion 98 to cause rod 96 to rotate about its longitudinal axis against the biased force of springs 96*a* and 96*b* and, thereby, rotate arms 101 in a generally counter clockwise direction as viewed in FIG. 5 to thereby disengage latch mechanisms 100 from engagement with the hooks (104) on the clamp assembly. Once disengaged, the clamp assembly 12 will pivot out of the recess against the resistance provided by a spring 105 so that the clamp assembly 12 can be lowered slowly without additional force, but with additional force can be moved quickly should the need arise.

Referring again to FIG. 8, handle 92 is mounted to headboard 14 by a guide 106, which mounts to the rear inner surface 108 of headboard 14 with fasteners. Handle 92 may include a grip. As best seen in FIG. 8, supports 97*a*, which support the distal ends of rod 96, also provide support for latch mechanisms 100. To hide the various components of the quick release mechanism (with the exception of handle 92), headboard 14 includes a rear cover (not shown) that extends over and mounts to mounting posts 112 provided or formed on the rear inner surface of headboard 14 by, for example, fasteners. In this manner, similar to the clamp assembly and the drive assembly, most of the components of the quick release mechanism are concealed in the headboard to provide an integrated headboard design.

Alternately or in addition, the clamp assembly or headboard may be provided with one or more magnets and corresponding magnetic plates to releasably retain the clamp assembly in the headboard. For example, the magnets 114, such as permanent magnets, and/or magnetic plates may be located at the upper portion of the transverse member 62 and in the upper portion of the recess, for example, such as shown in FIG. 5.

As noted above, clamp assembly 12 is configured to clamp onto a panel on a patient support, such as a hospital bed. Referring to FIGS. 9-12, each clamping device 64, 66 includes a clamp base 120, with a receiver 122, and a clamp arm 124. For ease of description, only a single clamp will be described in detail; though it should be understood that the description that follows can apply to both clamping devices. Clamp arm 124 includes a compression member or bar 126 at its distal end for compressing and capturing a panel between compression member 126 and receiver 122. Optionally, receiver 122 comprises a resilient body 128 formed with a concave receiving surface 130 and into which compression member 126 is urged when the clamping device is in its clamped position. A suitable material for the receiver includes a compliant material, such as urethane or a rubber material. Clamp arm 124 is pivotally mounted to clamp base 120 by a link arm 132 (best seen in FIG. 10), which is pivotally mounted at its distal end about a first pivot axis 132*a* to base 120 and pivotally mounted at its proximal end about a second pivot axis 132*b* to clamp arm 124 between a pair of downwardly depending flanges 136, which project downwardly from the underside of clamp arm 124. Further, clamp arm 124 is pivotally mounted between a pivotal flange 140 and an actuating or lever arm 142. Pivotal flange 140 and lever arm 142 are both pivotally mounted at a mounting point at one end to base 120 and pivotally mounted to arm 124 at a pivot point spaced from or eccentric from their mounting points to base 120. As best seen in FIG. 10, lever arm 142 and flange 140 are pivotally coupled to arm 124 at downwardly depending flanges 144 and 146, which project downwardly from the underside of clamp arm 124 but which are spaced outwardly from flanges 136.

Figure 9:
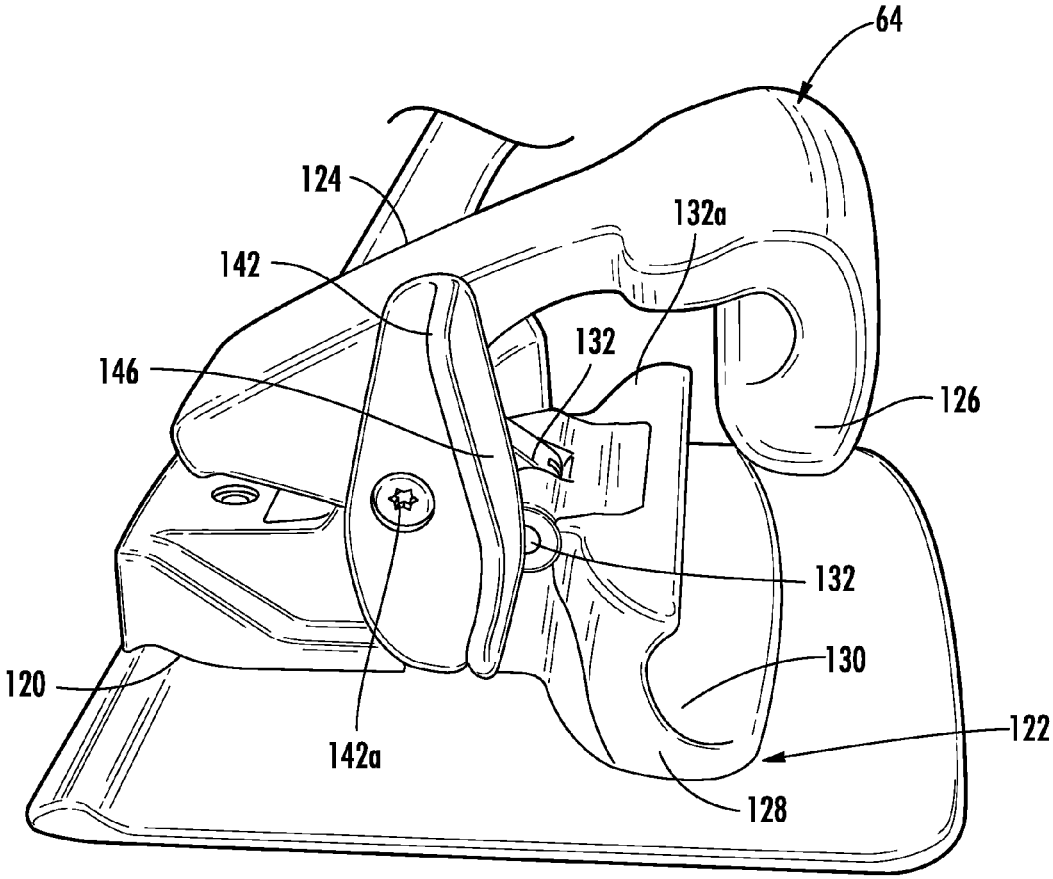
FIG. 9 is an end view of the clamp assembly of FIG. 2 illustrating a clamping device in an unclamped position.
Figure 10:
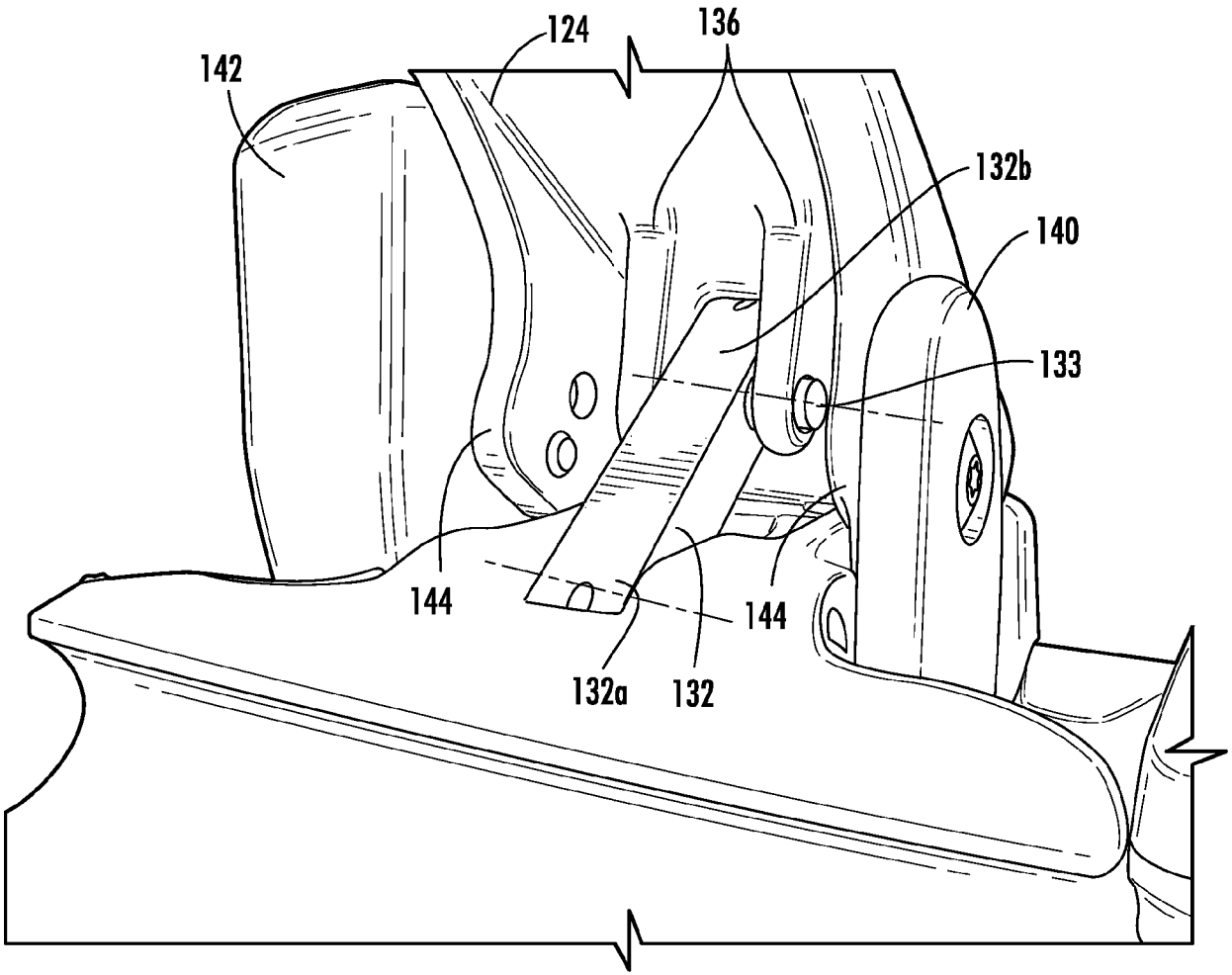
FIG. 10 is an enlarged view of the clamping device of FIG. 9 illustrating the mounting arrangement of the clamp arm.

As best seen in FIG. 9, lever arm 142 includes a laterally extending rib or web, which provides a gripping or engagement surface so that lever arm 142 can be manually manipulated by an attendant. Furthermore, link arm 132 comprises a channel-shaped member, which houses a spring that extends from base 120 to pivot pin 133 to urge clamp arm 124 to its raised and unclamped position, such as shown in FIG. 9.

Figure 11:
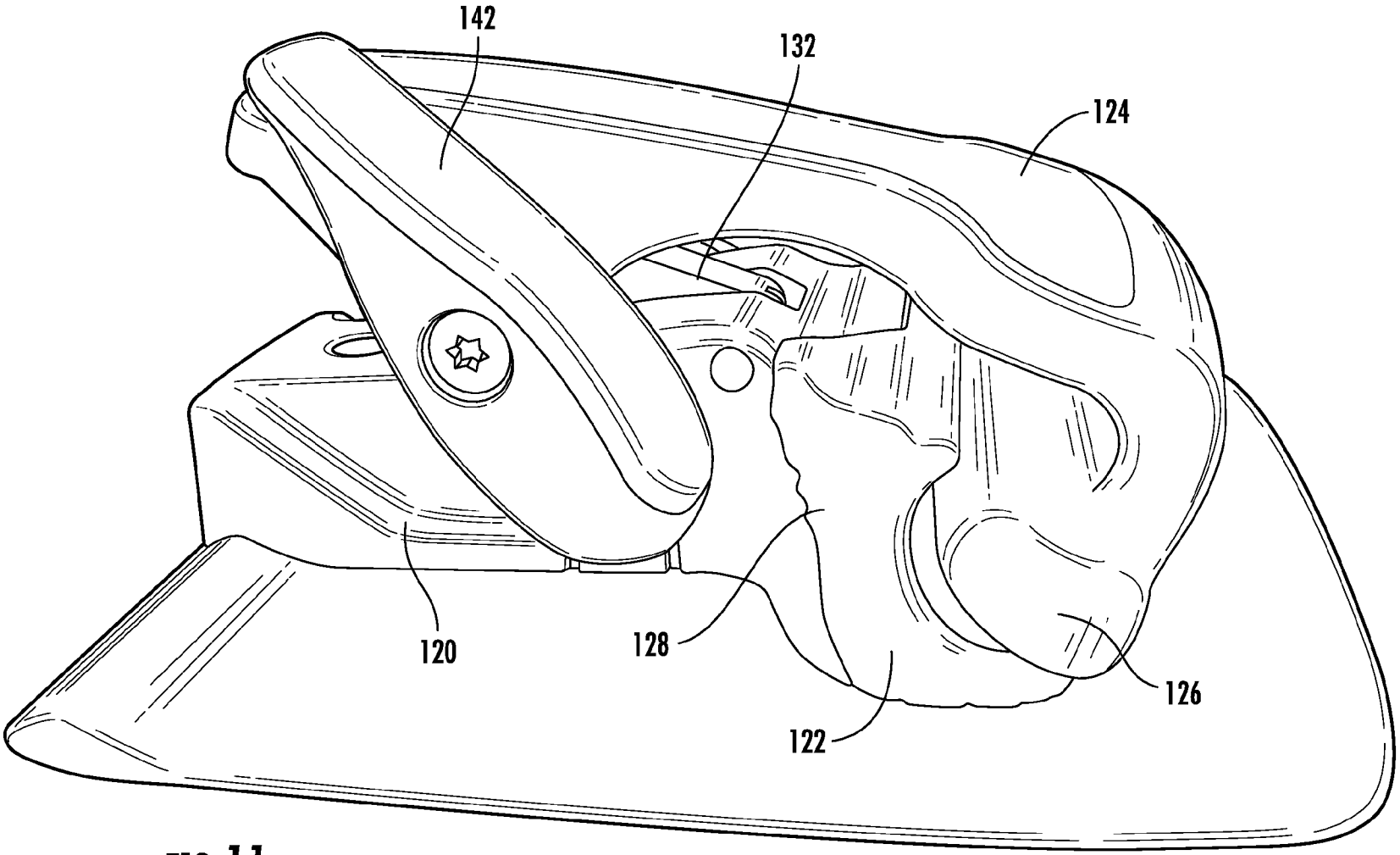
FIG. 11 is a perspective view of the clamping device of FIG. 9 showing the clamping arm in a pre-clamping position.
Figure 12:
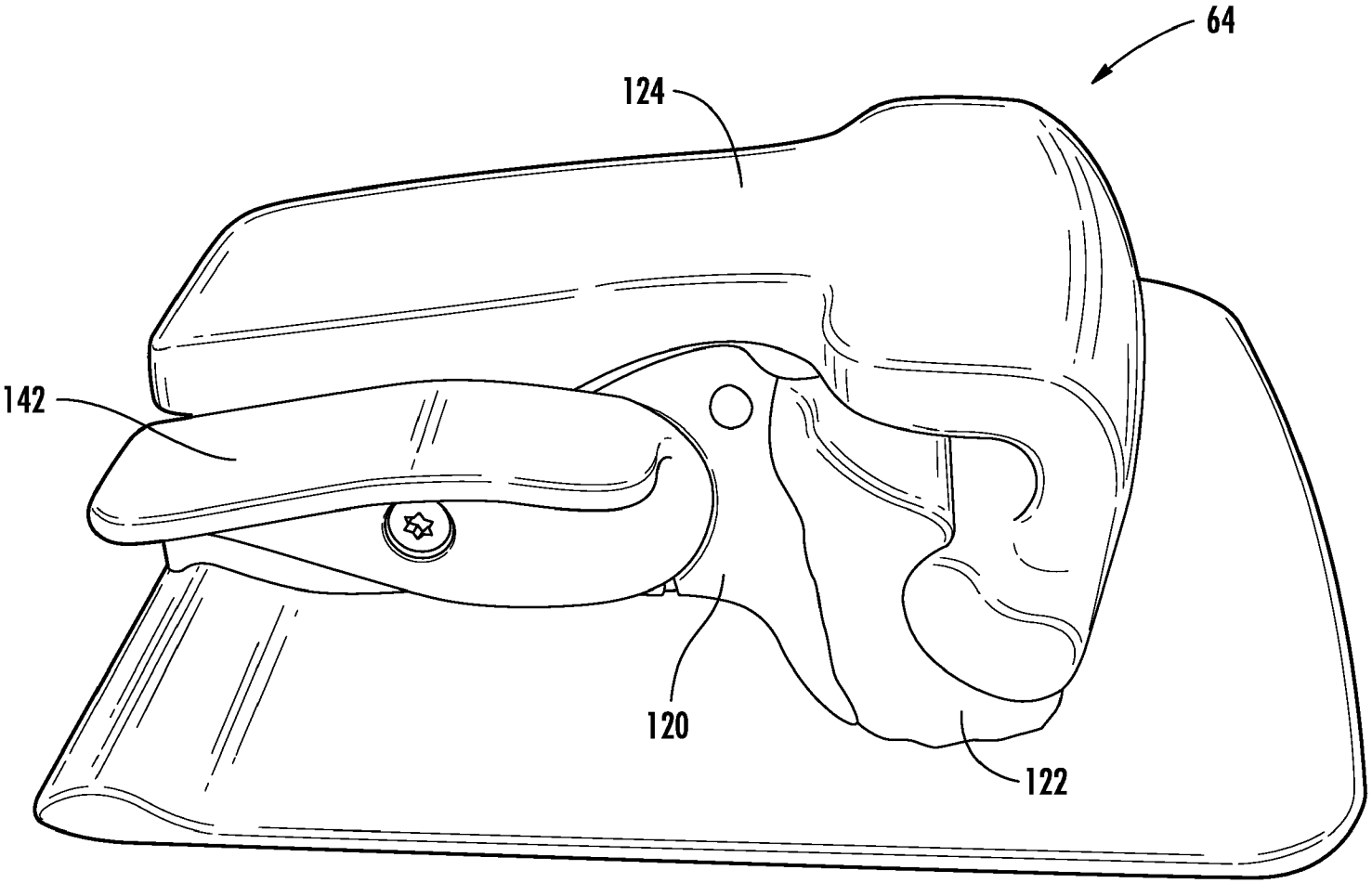
FIG. 12 is a similar view to FIG. 11 showing the clamp arm in a clamping position.

Referring again to FIG. 9, in order to close the clamp assembly, lever arm 142 is pivoted around its pivot axis 142*a* in a clockwise direction (as shown in FIG. 9), which will induce rotation of clamp arm 124 about first pivot axis 132*a* and further about second pivot axis 132*b*, which causes clamp arm 124 to lift up and over receiver 122 and further move forward relative to clamp base 120 so that compression member 126 is moved forward relative to receiver 122. In this position, there is sufficient space between the compression member 126 and receiver 122 to allow an edge of a panel, such as a sheet or pad, to be placed over the receiver and preferably with its edge positioned so that it drapes over the top of the receiver and onto the base 120. Thereafter, lever arm 142 is pivoted in a counterclockwise direction (as shown in FIGS. 9 and 11-12) to rotate from a generally twelve o'clock position to a nine O'clock position, which causes clamp arm 124 to pivot in a reverse direction about first pivot axis 132*a* and about second pivot axis 132*b* to move compression member 126 downwardly toward the receiver and then into the receiver where it is fully seated in receiver and, further, compressed against the receiver to thereby frictionally engage a panel between compression member 126 and receiver 122.

As noted above, receiver 122 may comprise a body formed from a resilient material, which provides increased friction between the panel and the receiver and, further, allows the receiver to accommodate different thicknesses of panels. To release the panel, lever arm 142 is rotated in a clockwise direction as viewed in FIG. 9, which relieves the compression force exerted by compression member 126 against the receiver and, thereafter, moves the compression member away from the receiver from its clamping position to a preclamping position wherein the panel may be removed from the clamping device.

Figure 13:
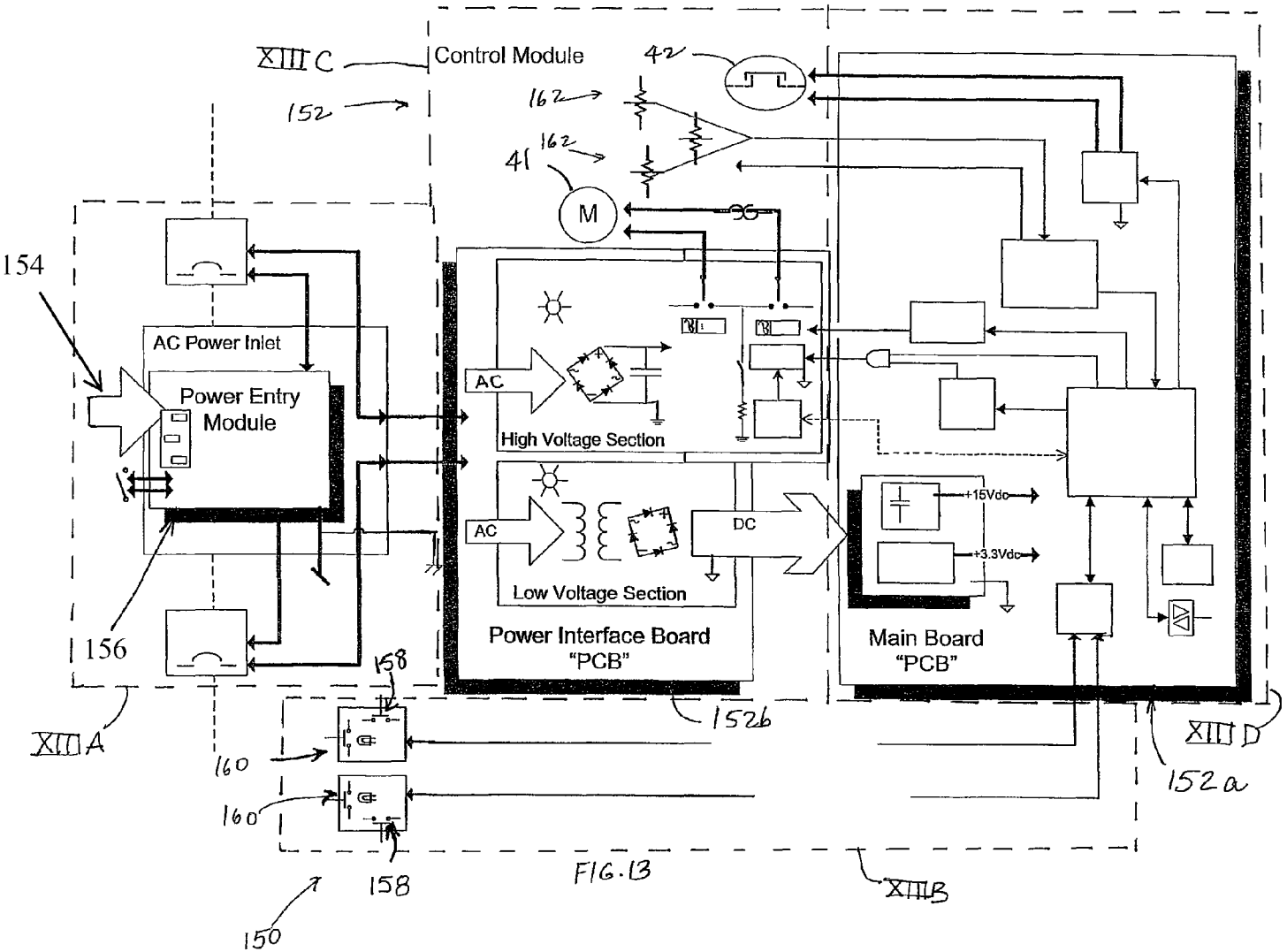
FIG. 13 is a schematic view of the control system of the patient repositioning system.
Figure 13A:
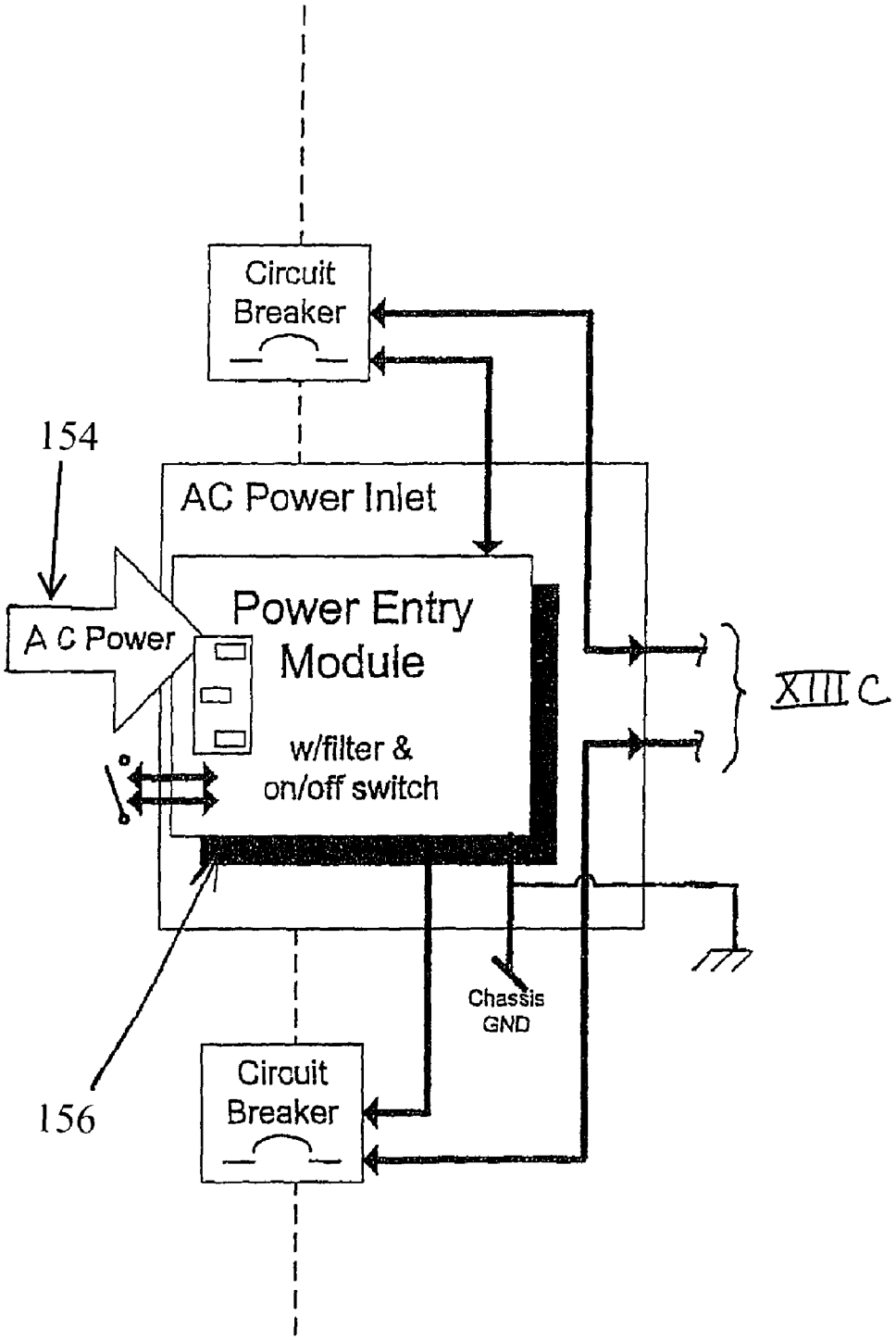
Figure 13B:
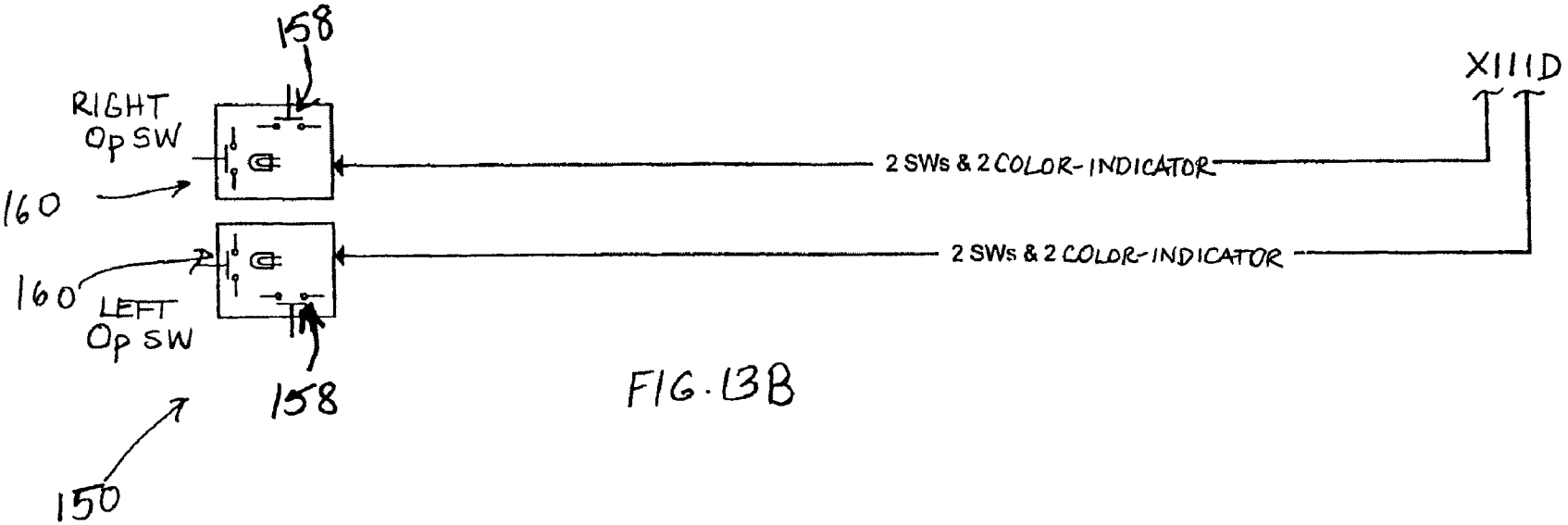
Figure 13C:
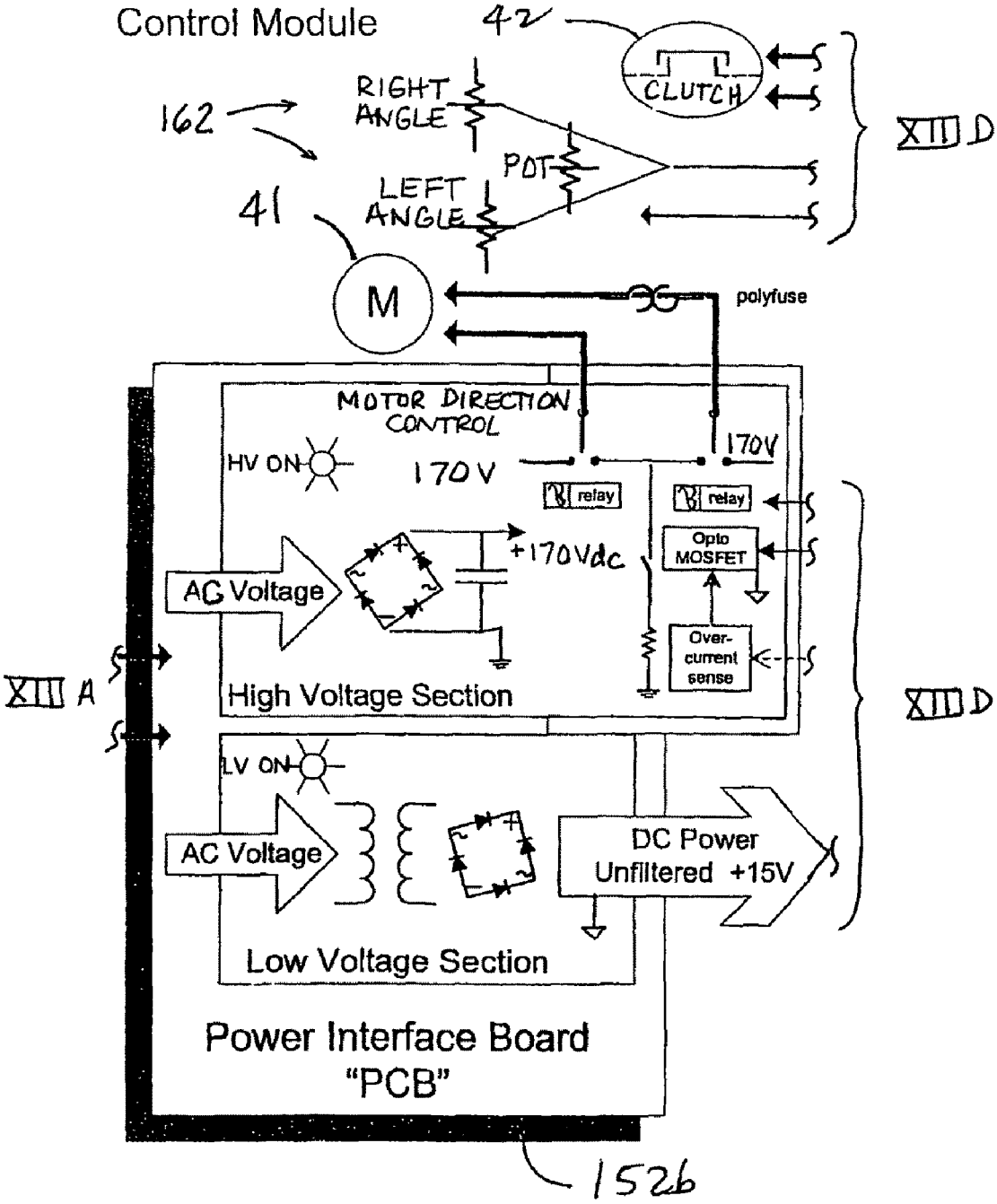
Figure 13D:
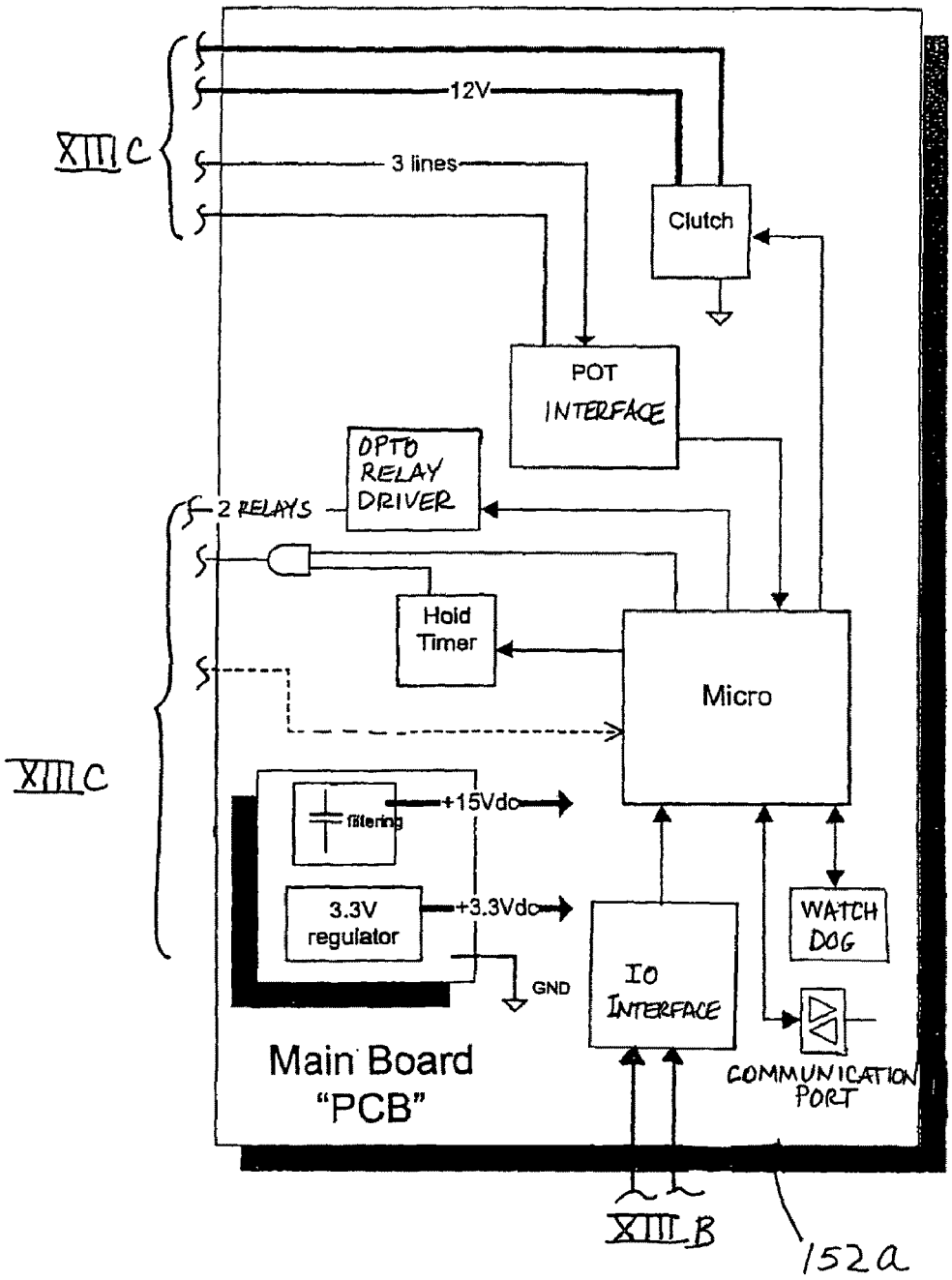

As noted above, shaft 32 is driven by drive assembly 30. Referring to FIG. 13, drive assembly 30 is controlled by a control system 150. Control system 150 includes a control module 152, with a main control board 152*a* (with a microprocessor and supporting circuitry) and a power interface board 152*b*, which couples to a power supply 154, such as a power supply external to the bed, through a power entry module 156. Power interface board 152*b* converts the high AC voltage received from the power entry module 156 into a low DC voltage through a transformer and a converter, such as a bridge circuit, which is then delivered to main control board 152*a*. Further, board 152*b* converts the high AC voltage into a high DC voltage for driving motor 41 as controlled by main control board 152*a*.

The power entry module 156 includes anon/off switch that may be mounted to the drive unit or located in a power cord, which plugs into, for example, an electrical wall socket and which turns the power off to control system 150. Alternately, the cord may couple to the patient support power supply, if one is available. Therefore, the power to the motor is delivered through and controlled by control module 152.

Main control board 152*a* is in communication with a drive switch 158, which is located, for example at the side of drive unit 16 where it is accessible by an attendant. Drive switch 158 generates drive signals to controller 152 only when suppressed; therefore, when main control board 152*a* no longer receives a signal from drive signal 158, the controller will no longer allow electric current to be transmitted to motor 41.

In addition, control system 150 includes one or more system disable switches 160, which are in communication with main control board 152*a*. Switches 160 are actuated by pressure and, further, optionally only after pressure is applied for a predetermined period of time, for example in a range of 2 to 5 seconds. For example, main control board 152*a* may receive the signal from the switch and check to see if the signal is still preset after a predetermined time. If the signal is still present, the main control board 152*a* then reads the signal as an actuating signal. Alternately, the switch may have a timer and only generate a signal after pressure is applied for the predetermined time. In addition, to confirm the user has actually disabled the system, respective switches 160 may incorporate a light or sound producing device that is actuated when the switch has been depressed for the predetermined time.

Once main control board 152*a* has detected that one of the disabled switches 160 has been actuated, main control board 152*a* will disable control system 150 until reset by reactuation of one of the disable switches 160, again which may occur only after the switch is depressed for a predetermined time. Switches 160 are provided to allow an attendant to disable the control system of the patient repositioning system so that when the attendant leaves, for example the hospital room, an unindoctrinated person cannot operate the system. Further, switches 160 may be configured to only disable the control system 150 when control system 150 is in a non-operating mode—that is when the system is idle and the drive switch 158 is not being actuated.

In addition, in order to assure that the patient repositioning system is operated only when the tethers are extended from the drive unit in a horizontal fashion and, therefore, avoid undesirable stresses on the winding assembly and the winding assembly mounting arrangement within housing 15, system 150 includes a sensor 162 (see FIGS. 3 and 13) for each tether that detects when the tethers are no longer parallel. For example, in the illustrated embodiment, sensor 162 is positioned to detect the orientation of pivotal guide 60 and generates a signal when sensor 162 detects that guide 60 in no longer oriented parallel to the drive unit housing upper wall to indicate that the tether is no longer in its horizontal position. This signal is transmitted to main control board 152*a*, which then terminates power to the motor 41 regardless of the actuation of drive switch 158. For example, a suitable sensor may include proximity sensor, a pressure sensor, or the like.

Further, in order to maintain the horizontal relationship of the tethers relative to the patient support, spacers may be provided between the drive unit and the mounting posts on the bed patient support. In this manner, the drive unit height may be adjusted, for example when a thicker mattress is placed on the patient support.

Referring again to FIG. 1, both headboard 14 and drive unit 16 cover or housing are formed from a plastic material such as a plastic, such as a polypropylene, including polypropylene ABS. For example, headboard 14 may be constructed from a metal tubular frame over which the plastic may be molded to form the front and rear surfaces of the headboard and further so that the headboard is hollow to thereby reduce the weight of the headboard. Further, hand holds may be formed at the upper side edges of the headboard to facilitate removal of the headboard.

As noted above, transverse member 62 may be formed from a rigid material, for example metal, including aluminum, or may be formed from a reinforced polymer, depending on the desired capacity for the clamp assembly. Similarly, the components that form the clamping devices may be formed from a metal material or from a reinforced polymer, again depending on the capacity desired for the clamp assembly. Pivot guides 60 may be similarly formed from metal or a plastic, including a low friction plastic, such as a high density polypropelene (HDPE).

Figure 4B:
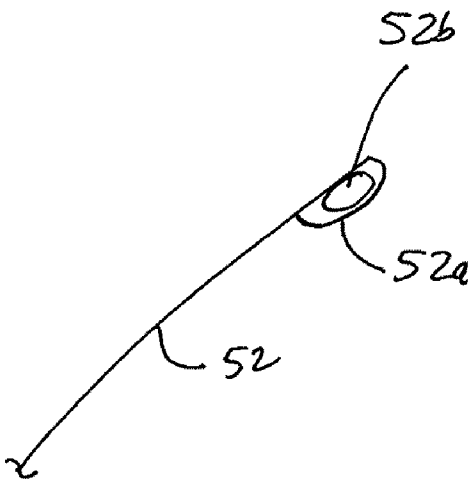
FIG. 4B is an enlarged view of the end of the strap.
Figure 4A:
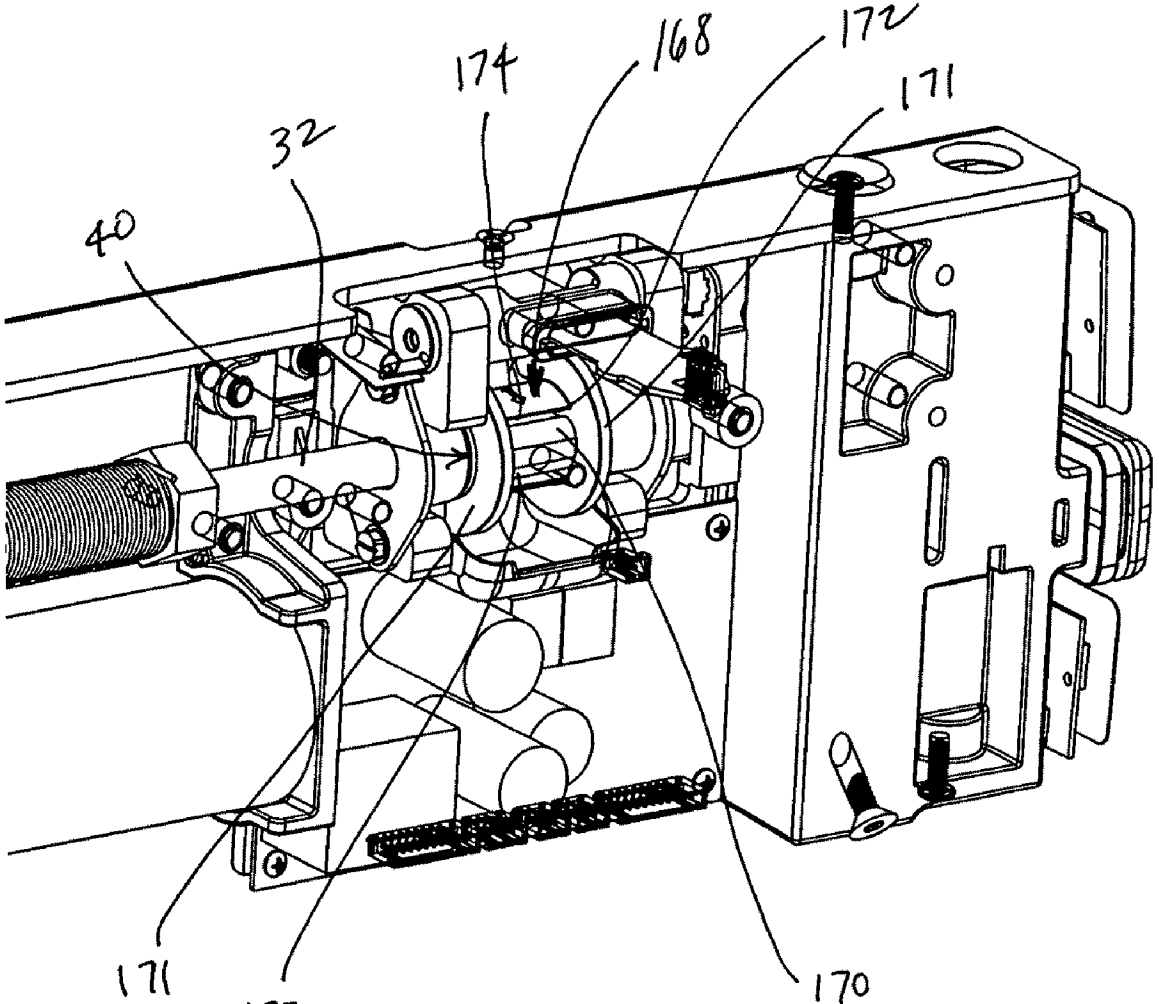
FIG. 4A is an enlarged perspective view of a reel of the winding assembly.

As best seen in FIGS. 4A and 4B, tethers 52 may be releasably mounted to the respective reels. Optionally, tethers 52 are removable to allow cleaning of the tethers or replacement of the tethers as desired. As best seen in FIG. 4A, each reel includes a central cylindrical body 168 and a pair of retaining flanges 171. Cylindrical body 168 includes a winding surface 170 that includes one or more transverse passageways 172, 178 which extend through body 168 from one side of the winding surface to another side of the winding surface. The proximal end of each tether is then inserted into the opening 174 formed by one side of the transverse passageway and into the passageway 172 to exit through the opening on the opposed side of the winding surface. Optionally, the proximal end of the tether may be then extended through in a reverse direction back through the optional lower passageway 178 to loop the tether through the central cylindrical body 168 of reel 140.

Once extended through the upper or lower passageway, the proximal end of the tether is enlarged to thereby capture the tether and secure the proximal end of the tether to the reel. For example, as best seen in FIG. 4B, the proximal end of the tether may include the looped portion 52*a* through which a retaining body 52*b*, such as a rod or pin, may be extended to thereby enlarge the distal end of the tether. Further, body 52*b* is preferably incompressible so that once positioned in the loop, the end of the tether is enlarged and can not be easily compressed. However, once the rod or pin is removed, the proximal end of the tether can then be compressed and rethreaded back through the transverse passageway or passageways to disconnect the tether from the reel.

Alternately or in addition, each reel 40 may be releasably mounted to the shaft 32. For example, each reel 40 may be configured as a cassette that mounts on to the shaft.

Figure 4C:
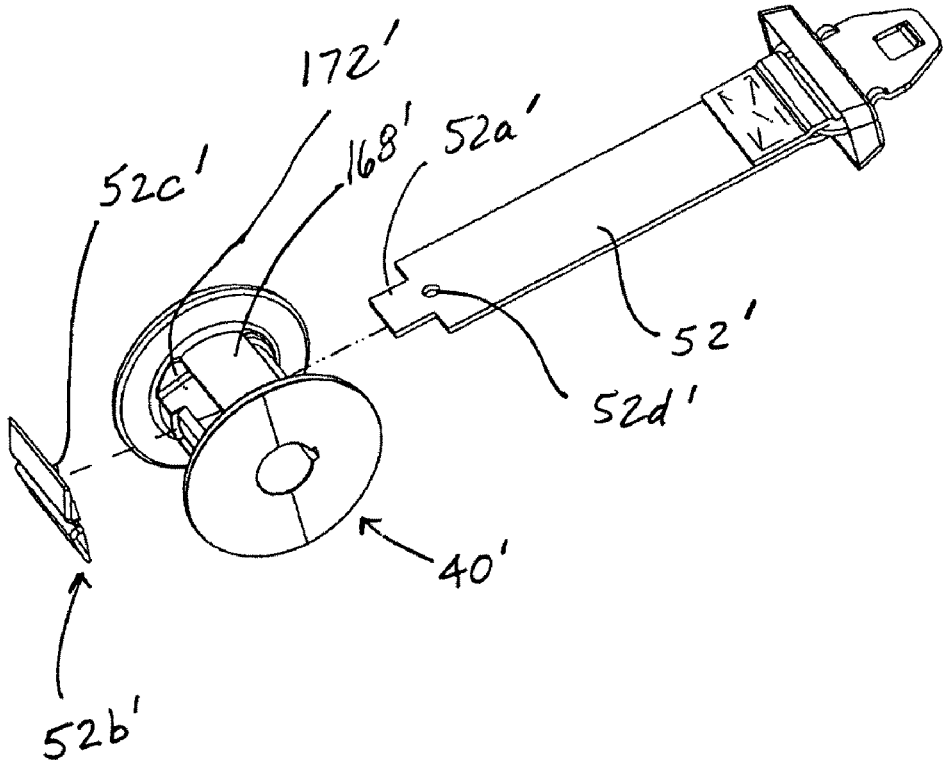
FIG. 4C is an exploded perspective view of another embodiment of a tether and a reel of the winding assembly.
Figure 4D:
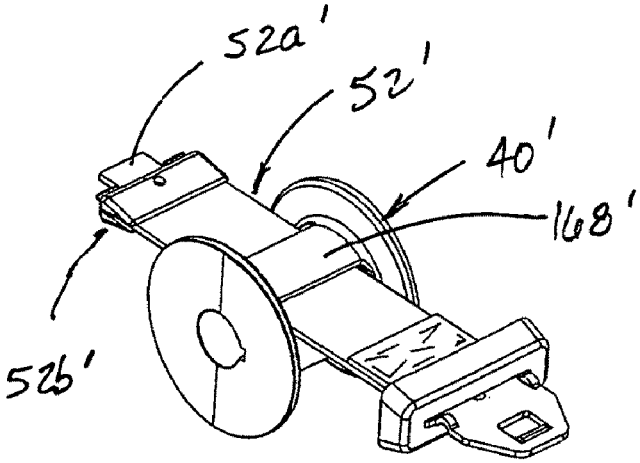
FIG. 4D is a perspective view of the tether attached to the reel of FIG. 4C.

Referring to FIGS. 4C and 4D, in an alternate embodiment, tether 52' may include mounted over its proximal end a removable body 52*b*', such as a plastic body that snaps onto the proximal end of tether 52', to thereby capture the end of the tether on reel 40' in a similar manner to tether 52. For example, in the illustrated embodiment, body 52*b*' comprises a plastic body with two wedge-shaped portions that are joined, for example, by a living hinge, at its medial portion onto the end of tether. When folded they form a wedge-shaped plastic body. Body 52*b*' further includes a projecting pin 52*c*' on one half of the body facing one side of the tether so that when body 52*b*' is folded onto the end of tether 52', pin 52*c*' extends through an opening 52*d*' formed at or near the proximal end of tether and into a round recess formed on the other half of body 52*b*' and with which it forms a snap coupling. Therefore, body 52*b*' is removably mounted to the tether.

Similar to reel 40, reel 40' include a passageway 172' for threading the tether through the central cylindrical body 168' of the reel and thereafter have body 52*b*' mounted to the end of the tether than is threaded through the reel. As would be understood from the previous embodiment, passageway 172' is sized to prevent the wedge-shaped body from passing there through to thereby couple the tether to the reel. Similar to body 52*b*, body 52*b*' acts as a stop so that the proximal end of the tether can not be removed after it has been threaded through the reel and the body mounted to the end of the tether without removing the wedge-shaped body (because the other end of the tether is also enlarged by the buckle mounted to the distal end of the tether).

Additionally, passageway 172' may be sized to receive the wedge-shaped body 52*b*' in body 168' so that the wedge-shaped body does not project significantly, if at all, from the cylindrical body. For example, the passageway may be sized so that the end or outermost surface of the wedge-shaped body may be flush or sub-flush (i.e. below or just below) with respect to the outer surface of the cylindrical body. As a result, the tether can be wound around the reel with a fairly uniform winding.

Further, the end of tether may be formed with a tab 52*a*', which projects through body 52*b*', for example through an opening provided in the living hinge. Tab 52*a*' may provide a pull tab so that when body 52*b*' is mounted to tether 52' and recessed in body 168', tab 52*a*' allows the wedge to be pulled and disengaged from the central body so that the wedge-shaped body can then removed from the end of the tether, for example, when the tether is to be disengaged from the reel for cleaning or replacement.

While several forms of the invention have been shown and described, other changes and modifications will be appreciated by those skilled in the relevant art. For example, as noted above, the tethers may comprise straps, cables or ropes, chains, tapes, or the like. Further, while the headboard and drive unit are described as being mounted using post and socket mounting arrangements; other mounting arrangements may be used. Further, either one or both may incorporate a latch and a latch release mechanism, including a release mechanism, such as described herein for the clamp assembly. In addition, while two tethers, two latching mechanisms, and two clamping devices are described herein one or more aspects of the present invention may be achieved with a single tether, latch mechanism and/or clamping device or with more than two tethers, latch mechanisms and/or clamping devices. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

The embodiments of the invention in which an exclusive property right or privilege is claimed are defined as follows:

1. A patient repositioning system comprising:

a drive unit mounted to a head end of a patient support, said drive unit having a housing and a winding assembly supported in and enclosed by said housing, and said winding assembly including a tether;

a headboard releasably mounted onto said drive unit wherein said drive unit is beneath and interposed between said headboard and said head end of said patient support, and said headboard disengaged from said drive unit when said headboard is removed from said head end of said patient support; and a clamp assembly, said clamp assembly having a stowed position when mounted in said headboard, said tether coupled to said clamp assembly when said clamp assembly is in its stowed position in said headboard and when said headboard is mounted to said drive unit, and when said clamp assembly is removed and deployed from said headboard to a deployed position said clamp assembly configured for coupling to a panel on the patient support.

2. The patient repositioning system according to claim 1, wherein one end of said tether remains coupled to the winding assembly and another end of said tether is coupled to said clamp assembly when said clamp assembly is being deployed from said headboard, and further said other end of said tether decoupled from said clamp assembly when said headboard is removed from said head end of said patient support and disengaged from said drive unit.

3. The patient repositioning system according to claim 1, wherein said clamp assembly includes a latching mechanism, and said latching mechanism aligning with said tether and engaged with said tether when said headboard is mounted onto said drive unit.

4. The patient repositioning system according to claim 3, wherein said tether includes a tab, said latching mechanism latching onto said tab when said clamp assembly is being deployed from said headboard.

5. The patient repositioning system according to claim 4, wherein said headboard deactivates said latching mechanism when said clamp assembly is in its stowed position in said headboard wherein said latching mechanism is unlatched from said tab and no longer deactivates said latching mechanism when said clamp assembly is being deployed from said headboard wherein said latching mechanism is latched with said tab.

6. The patient repositioning system according to claim 4, wherein said clamp assembly is located in a recessed portion of said headboard when in its stowed position in said headboard, said recessed portion of said headboard including a projection aligned with said latching mechanism when said clamp assembly is in its stowed position, said projection suppressing actuation of said latching mechanism when said clamp assembly is in its stowed position to thereby inhibit actuation of said latching mechanism and no longer suppressing actuation of said latching mechanism when said clamp assembly is being deployed wherein said latching mechanism latches onto said tab and thereby couples said tether to said clamp assembly when said clamp assembly is being deployed from said headboard.

7. The patient repositioning system according to claim 1, wherein said clamp assembly includes a plurality of clamping devices.

8. The patient repositioning system according to claim 7, wherein said clamping devices are supported by and mounted to a transverse member, and when coupled to said clamping device said tether coupled to said transverse member.

9. The patient repositioning system according to claim 1, wherein said tether comprises a strap.

10. The patient repositioning system according to claim 1, wherein said winding assembly includes a shaft supported for rotation about a longitudinal axis and a reel supported on said shaft and coupled with said shaft for rotation with said shaft, said reel having a central body with a winding surface and a transverse passage extending through said central body, and said tether having a proximal end, said tether threaded through said transverse passage, and said proximal end having a thickness greater than said transverse passage wherein said tether is releasably trapped in said transverse passage and coupled to said reel by said proximal end.

11. The patient repositioning system according to claim 10, wherein said proximal end of said tether includes a removable body, said removable body increasing the thickness of the tether at or adjacent said proximal end when said removable body is mounted at or near said proximal end.

12. The patient repositioning system according to claim 11, wherein said removable body comprises a pin or a wedge-shaped body.

13. The patient repositioning system according to claim 10, wherein said reel includes two transverse passageways extending through said central body, and said tether is threaded through both of said transverse passageways.

14. A patient repositioning system comprising:

a headboard releasably mounted to a head end of a patient support, said headboard having a recess forming a compartment in said headboard;

a clamp assembly having at least one clamping device, said clamp assembly removably stowed in said headboard in said compartment, when said clamp assembly is removed and deployed from said headboard said clamp assembly is configured to couple to a panel on the patient support, said clamp assembly having a patient facing surface and an inwardly facing surface when mounted in said recess of headboard, said inwardly facing surface supporting said clamping device, and said patient facing surface closing said recess when said clamping assembly is mounted in said recess such that said clamping device is concealed in said headboard; and said clamp assembly forming a releasable pivot connection in said compartment when mounted in said recessed portion, when said clamp assembly forms said releasable pivot connection said clamp assembly being pivotal about said pivot connection between a stowed position in said headboard to a deployed position and further when released and decoupled from said pivot connection said clamp assembly being movable out from said headboard and extendible from said headboard to a deployed position for coupling to a panel on the patient support spaced from said headboard.

15. The patient repositioning system according to claim 14, wherein said pivot connection includes a pivot member with a guide surface guiding said clamp assembly onto said pivot member to thereby form said releasable pivot connection.

16. The patient repositioning system according to claim 15, wherein said releasable pivot connection comprises a pair of releasable pivot connections at said recess, and said clamp assembly being pivoted about said pair of releasable pivot connections when moved between said stowed position in said headboard to said deployed position.

17. The patient repositioning system according to claim 16, wherein said pivot connections each include a pivot member with a guide surface for guiding said clamp assembly onto said pivot members to thereby form said releasable pivot connections.

18. The patient repositioning system according to claim 14, wherein said clamp assembly includes a pair of clamping devices and a transverse member supporting said clamping devices.

19. The patient repositioning system according to claim 18, wherein said releasable pivot connection is formed with said transverse member.

20. The patient repositioning system according to claim 14, further comprising a drive unit mounted to the head end of the patient support, said headboard releasably mounted onto said drive unit wherein said drive unit is beneath and interposed between said headboard and said head end of said patient support, said drive unit having a winding assembly, and said winding assembly coupling to said clamp assembly when said clamp assembly is deployed from said compartment for selectively pulling on said clamp assembly.

21. The patient repositioning system according to claim 20, wherein said releasable pivot connection comprises a pair of releasable pivot connections, and said winding assembly includes a plurality of tethers, each of said tethers being guided from said drive unit by a pivotal guide, said pivotal guides forming said pair of releasable pivot connections with said clamp assembly.

22. The patient repositioning system according to claim 21, wherein each of said pivotal guides includes a guide surface guiding said clamp assembly onto said pivotal guides.

23. The patient repositioning system according to claim 22, wherein said drive unit includes a housing with a housing wall, said housing wall having a pair of openings, and each of said pivotal guides being pivotally mounted at a respective opening of said openings in said housing wall.

24. A patient repositioning system comprising:

a headboard adapted for releasably mounting to a head end of a patient support, said headboard having an uppermost perimeter edge, a patient facing side, and a recess extending into said patient facing side beneath said uppermost perimeter edge defining a compartment;

a clamp assembly stowed and enclosed in said headboard in said compartment, when said clamp assembly is deployed from said headboard said clamp assembly configured for coupling to a panel on the patient support, and said clamp assembly including a clamping device comprising:

a clamp base; and a clamp arm being pivotal about said clamp base and being movable from an open position to a closed position; and when said clamp assembly is moved to said stowed position said headboard moving said clamp arm to said closed position.

25. The patient repositioning system according to claim 24, wherein said recess includes a projection, said projection closing said clamp arm when said clamp assembly is moved to its stowed position.

26. The patient repositioning system according to claim 25, wherein said clamping device comprises a pair of clamping devices, each of said a clamping devices comprising a clamp base and a pivotal clamp arm movable from an open position to a closed position, said clamp assembly further including a transverse member supporting said clamping devices, said recess including a pair of projections for closing said clamp arms of said pair of clamping devices.

* * * * *